US005434027A

United States Patent [19]

Oshiba et al.

[11] Patent Number: 5,434,027

[45] Date of Patent: Jul. 18, 1995

[54] PHOTORECPTOR FOR ELECTROPHOTOGRAPHY AND IMAGE FORMING METHOD

[75] Inventors: Takeo Oshiba; Yoshihiko Etoh; Asao Matsushima; Yoshiaki Takei, all of Tokyo, Japan

[73] Assignee: Konica Corporation, Tokyo, Japan

[21] Appl. No.: 170,855

[22] Filed: Dec. 21, 1993

[30] Foreign Application Priority Data

| | | | |
|---|---|---|---|
| Dec. 25, 1992 | [JP] | Japan | 4-346192 |
| Jan. 8, 1993 | [JP] | Japan | 5-001954 |
| Jan. 21, 1993 | [JP] | Japan | 5-008568 |
| Jan. 21, 1993 | [JP] | Japan | 5-008569 |
| Jan. 28, 1993 | [JP] | Japan | 5-012664 |

[51] Int. Cl.[6] ..... G03G 5/06

[52] U.S. Cl. ..... 430/59; 430/64; 430/78; 430/126

[58] Field of Search ..... 430/73, 76, 77, 58, 430/59, 64, 78, 126

[56] References Cited

U.S. PATENT DOCUMENTS

| | | | |
|---|---|---|---|
| 5,223,364 | 6/1993 | Maeda et al. | 430/73 |
| 5,294,512 | 3/1994 | Suzuki et al. | 430/77 |

*Primary Examiner*—John Goodrow
*Attorney, Agent, or Firm*—Finnegan, Henderson, Farabow, Garrett & Dunner

[57] ABSTRACT

The present invention is directed to a photoreceptor having an electroconductive support, a barrier layer, a charge generation layer and a charge transport layer, all formed on the support in this order, wherein the barrier layer consists of an alcohol-soluble copolymerized polyamide resin, the charge generation layer contains a compound represented by formula I or II, and the charge transport layer contains a polycarbonate resin having a molecular weight of not less than 100,000,

I

II wherein Z represents a groups of atoms necessary to form a substituted or unsubstituted divalent aromatic ring.

36 Claims, 3 Drawing Sheets

PHOTORECPTOR FOR ELECTROPHOTOGRAPHY AND IMAGE FORMING METHOD

FIELD OF THE INVENTION

The present invention relates to an electro-photographic photoreceptor and an electrophotographic image forming method.

BACKGROUND OF THE INVENTION

Electrophotographic photoreceptors are available in two types: one based on inorganic photoconductive material and the other based on organic photoconductive material. With advantages such as freedom of environmental pollution, high productivity and low cost, organic photoconductive materials have recently been used commonly.

Of the organic photoconductive materials, those which generate charges upon visible light absorption are poor in charge retentivity, while those having good retentivity and excellent film-formability are generally poor in visible light photoconductivity. To solve this problem, it is common practice to functionally separate the light-sensitive layer into a charge generation layer (CGL) which absorbs visible light and generates a charge and a charge transport layer (CTL) which transport the charge. This allows separate choice of charge generation material (CGM) and charge transport material (CTM), affording broader ranges of criteria for choosing respective materials.

Conventional CGMs include polycyclic quinone pigments, perillene pigments, indigo pigments, bisbenzimidazole pigments, quinacridone pigments, phthalocyanine pigments, monoazo pigments, disazo pigments, trisazo pigments and polyazo pigments. Conventional CTMs include amine compounds, hydrazone compounds, pyrazoline compounds, oxazole compounds, oxadiazole compounds, stilbene compounds and carbazole compounds. For example, the use of perillene pigments as CGMs is disclosed in Japanese Patent Examined Publication No. 5423/1986 and Japanese Patent Publication Open to Public inspection (hereinafter referred to as Japanese Patent O.P.I. publication) Nos. 192958/1982, 59686/1984 and 122954/1985.

In addition to CGL and CTL, auxiliary layers such as a barrier layer (BAL), a protective layer and an adhesive layer and the order of their coating are being investigated.

SUMMARY OF THE INVENTION

To obtain satisfactory electrophotographic properties from a multiple-layered electrophotographic photoreceptor having a functionally separated CGL and CTL as described above, the following requirements are met:

(1) The CGM efficiently generates a charge in response to the light it has absorbed.

(2) The generated charge is efficiently injected to, and transported in, CTM.

No satisfactory light response can be obtained, unless both requirements are met.

When the electrophotographic photoreceptor has CGL and CTL arranged in this order and light is irradiated from the CTL side, the CTL must be sufficiently transparent to the light active on CGL to obtain high sensitivity.

For preparing an electrophotographic photoreceptor using known CGM and CTM, the CGM and CTM meet the above-described requirements and are satisfactory as to electrophotographic properties such as sensitivity, reception potential, potential retention, potential stability, residual potential and spectral property, operational properties such as strength, durability, stain resistance and printing durability, production stability and quality stability in coating, and ocher factors. However, it has been very difficult to choose a combination of materials which meet all these requirements. A photoreceptor having good initial chargeability and sensitivity and retain satisfactory properties even in long-term use, in particular, has been very difficult.

The object of the present invention is provide an electrophotographic photoreceptor which meet the basic requirements for electrophotographic photoreceptors and which has good initial chargeability and sensitivity and which retains high sensitivity and excellent potential stability even after long-term use.

More specifically, the object of the present invention is to provide an electrophotographic photoreceptor which retains high sensitivity and excellent potential stability even after long-term use, by using a perillene pigment, expected to obtain high sensitivity, as a charge generation material.

The photoreceptor of the present invention comprises an electroconductive support, and a barrier layer, a charge generation layer and a charge transport layer, all formed on the support in this order, wherein said barrier layer consists of an alcohol-soluble copolymerized polyamide resin, said charge generation layer contains a compound represented by formula I or II, and said charge transport layer contains a polycarbonate resin having a molecular weight of not less than 100000. The charge transport layer is preferably coated in the form of a solution in a solvent highly capable of dissolving the polycarbonate.

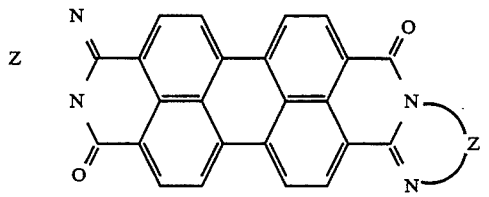

I

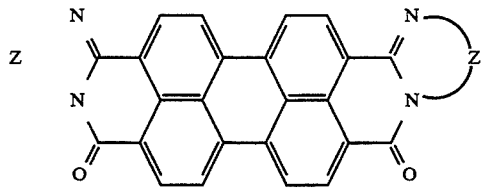

II

In the formulas Z represents a group of atoms necessary to form a substituted or unsubstituted divalent aromatic ring.

The solvent highly capable of dissolving the polycarbonate is preferably methylene chloride, tetrahydrofuran or chloroform. The CTM contained in CTL is preferably a compound represented by formula Ta or Tb.

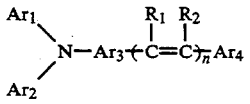

Ta

-continued $$Ar_5\text{-}(\text{-}N\text{-}Ar_6\text{-}(\text{-}C(R_1)=C(R_2)\text{-})_n Ar_7)_2 \qquad \text{Tb}$$

The major component of the barrier layer (BAL) is preferably a polyamide resin. The charge generation layer preferably comprises a polyvinyl butyral resin having a degree of butyralation of not lower than 70 mol % and a compound represented by formula I or II contained therein. The charge generation layer is preferably coated after dispersion and dissolution in a ketone solvent as the major solvent.

The fluidity of the charge generation layer coating compound preferably meets the following requirement:

$$\tau=\tau_0+\eta D^B (0.7 \leqq B \leqq 1.3)$$

where $\tau$ represents shear stress, D represents shear rate, $\eta$ represents coefficient of viscosity, $\tau_0$ represents the value for $\tau$ when D is 0, and B represents the exponent of D.

DETAILED DESCRIPTION OF THE INVENTION

Figure 1:
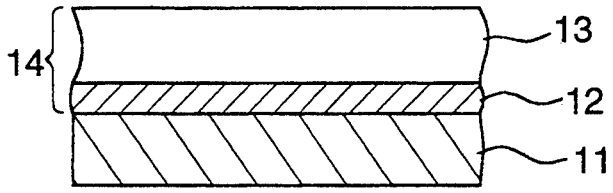
FIGS. 1-(*a*) through 1-(*d*) are cross-sectional views of photoreceptors showing their layer configuration.
Figure 1:
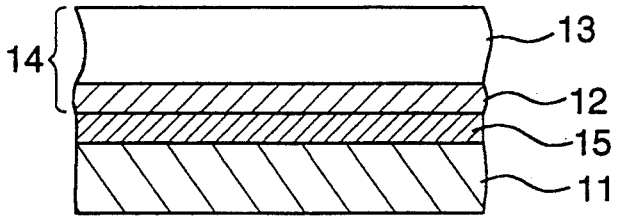
Figure 1:
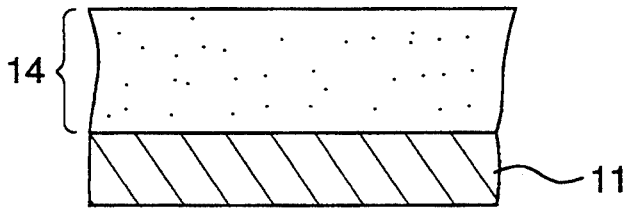
Figure 1:
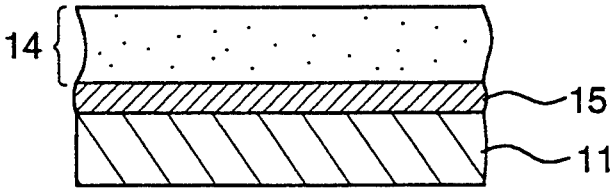

When the CGM of the present invention is used, not only sufficient initial sensitivity is obtained but also high sensitivity is stably retained for a long time. The barrier layer of the present invention, incorporating a polyamide resin, retains the initial sensitivity and chargeability even after long-term use. When a polycarbonate resin having a molecular weight of not less than 100000 is used as a binder resin for CTL, sufficient sensitivity and charging potential can be retained even after long-term use.

CTL is often obtained by coating a solution of CTM and a binder resin in an organic solvent. When a polycarbonate of high molecular weight is used, a problem of difficult coating arises because of the high viscosity of its solution.

As a solution to this problem, it may be possible to use a solvent highly capable of dissolving the polycarbonate. However, this approach is undesirable because of drawbacks such as swelling and dissolution of lower layers (BAL and CGL), their dissolution in, and mixing with, CTL, sensitivity reduction and increased residual potential.

Good results were obtained by using an alcohol-soluble polymerized polyamide resin as the major component of BAL and incorporating the pigment of the present invention to CGL.

With respect to the bisimidazopyridonoperillene (referred to as BIPP) represented by formula I or II, preferable aromatic rings for Z include the benzene ring, naphthalene ring, anthracene ring, phenanthrene ring, pyridine ring, pyrimidine ring, pyrazole ring and anthraquinone ring, with preference given to the benzene ring or naphthalene ring. The aromatic ring for Z may be substituted. Said substituent is exemplified by an alkyl group, an alkoxy group, an aryl group, an aryloxy group, an acyl group, an acyloxy group, an amino group, a carbamoyl group, a halogen atom, a nitro group and a cyano group.

Examples of BIPP for the present invention are given below.

| Example Compound No. | Z |
|---|---|
| A-1 | 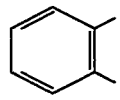 |
| A-2 | 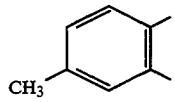 |
| A-3 | 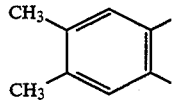 |
| A-4 | 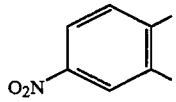 |
| A-5 | 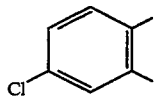 |
| A-6 | 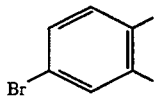 |
| A-7 | 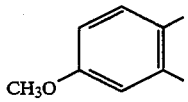 |
| A-8 | 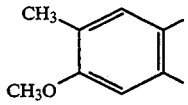 |
| A-9 | 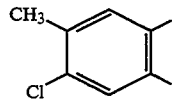 |
| A-10 | 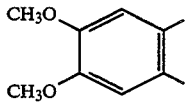 |
| A-11 | 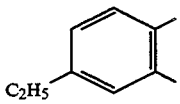 |

-continued

| Example Compound No. | Z |
|---|---|
| A-12 | 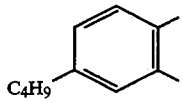 |
| A-13 | 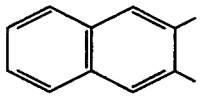 |
| A-14 | 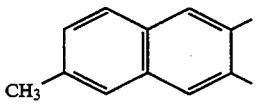 |
| A-15 | 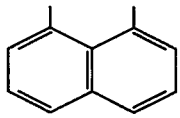 |
| A-16 | 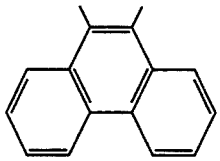 |
| A-17 | 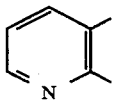 |
| A-18 | 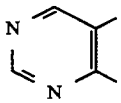 |
| A-19 | 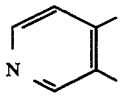 |
| A-20 | 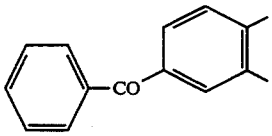 |
| A-21 | 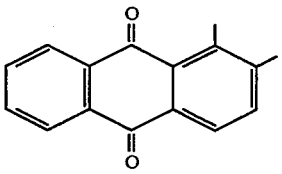 |

Such BIPP is characterized by high light absorption resulting in the capability of charge generation and radiation at high efficiency, high chemical stability resulting in the unlikeliness to be thermally or optically deteriorated, and good dispersibility resulting in good coating compound stability. Although BIPPs may be used singly, they may be used in combination of a number of kinds of different spectral wavelengths to broaden the sensitive wavelength band. In the present invention, these BIPPs preferably have a grain size of not more than 2 μm.

Although any binder resin can be used to form CGL, it is preferable to use a high molecular polymer capable of forming a hydrophobic, electro-insulating film of high dielectric constant. Such high molecular polymers are exemplified below.

P-1) Polycarbonate
P-2) Polyester
P-3) Methacrylic acid
P-4) Polyacrylic resin
P-5) Polyvinyl chloride
P-6) Polyvinylidene chloride
P-7) Polystyrene
P-8) Polyvinyl acetate
P-9) Styrene-butadiene copolymer
P-10) Vinylidene chloride-acrylonitrile copolymer
P-11) vinyl chloride-vinyl acetate copolymer
P-12) Vinyl chloride-vinyl acetate-maleic anhydride copolymer
P-13) Silicone resin
P-14) Silicone-alkyd resin
P-15) Phenol-formaldehyde resin
P-16) Styrene-alkyd resin
P-17) Poly-N-vinylcarbazole
P-18) Polyvinyl butyral
P-19) Polyvinyl formal These binder resins may be used singly or in a mixture of two or more kinds.

In the thus-formed CGL, the weight ratio of CGM, consisting of BIPP represented by formula I and/or II, is preferably 100:10 to 100:1000, from the viewpoint of light sensitivity, residual potential characteristic, dark decay characteristic and acceptance potential.

When CGL contains CTM, the ratio of CGM and CTM is preferably 10:0 to 10:1000, more preferably 10:0 to 10:100 by weight.

The layer thickness of the CGL formed is preferably 0.01 to 10 μm.

The polyvinyl butyral resin is particularly preferable as a binder resin for BIPP dispersion. Considering BIPP dispersibility, the degree of butyralation of the polyvinyl butyral resin is preferably not lower than 70 mol %.

Dip coating is suitable for CTL formation on CGL, but this method tends to cause swelling and dissolution of CGL, a lower layer. For this reason, the polyvinyl butyral resin preferably has a higher degree of polymerization, specifically not lower than 300.

The ratio of CGM and resin is preferably 10:1 to 1:2. more preferably, this ratio is 8:1 to 2:1 to ensure good CGM dispersibility, uniform layer formation and sufficient light sensitivity.

To obtain good dispersion stability, it is preferable to use a ketone solvent such as acetone, methyl ethyl ketone, methyl isobutyl ketone, methyl isopropyl ketone or cyclohexanone.

CGL can be formed by coating a coating solution, prepared is directed below, on an electroconductive support directly or via BAL formed on the support via an adhesive layer as necessary.

1) A solution of the above-described CGM in an appropriate solvent, with a binder resin also added and dissolved as necessary.
2) A dispersion of the above-described CGM in a dispersant, prepared as fine grains (grain size preferably not more than 5 μm, more preferably not more than 1 μm) using a ball mill, sand grinder or the like, with a binder resin and/or CTM added and dissolved as necessary.

The CTL relating to the present invention preferably incorporates a polycarbonate having a molecular weight of not less than 100000 as a binder for obtaining sufficient strength to ensure good printing durability.

The polycarbonate is preferably of the bisphenol A type, more specifically of the bisphenol Z type, in which substituents, preferably cyclic ones, are sterically complexly arranged on carbon atoms between two benzene rings.

Although this resin may be dissolved in any solvent capable of dissolving the polycarbonate, it is preferable to use methylene chloride, tetrahydrofuran or chloroform because high sensitivity and potential stability and good coatability are obtained.

Examples of CTM include oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinyl pyrene and poly-9-vinyl anthracene.

The CTM used in the present invention is preferably one which is highly capable of transporting the holes formed upon light irradiation to the photoreceptor's surface side or support side and which is compatible with the above-described CGM such as BIPP. Such CTM is exemplified by compounds represented by formula Ta and/or Tb.

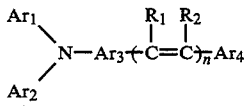

Ta

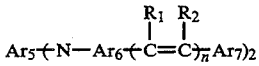

Tb

In the formulas $Ar_1$, $Ar_2$, $Ar_4$, $Ar_5$ and $Ar_7$ independently represent a substituted or unsubstituted aryl group; $Ar_3$ and $Ar_6$ independently represent a substituted or unsubstituted arylene group; $R_1$ and $R_2$ independently represent a hydrogen atom, alkyl group or aryl group which may have a substituent; n represents the integer 1 or 2.

Examples of such compounds are given on pages 3 and 4 of Japanese Patent O.P.I. Publication No. 65440/1983, pages 3 through 6 of Japanese Patent O.P.I. Publication No. 198043/1983 and pages 4 through 10 of Japanese Patent O.P.I. Publication No. 32265/1989.

In the thus-formed CTL, the CTM content is preferably 20 to 200 parts by weight, more preferably 30 to 150 parts by weight per 100 parts by weight of the binder resin in the CTL.

The thickness of the formed CTL is preferably 5 to 60 μm, more preferably 10 to 40 μm.

Electroconductive supports for the electrophotographic photoreceptor of the present invention include metal plates including alloys) and metal drums, and papers and plastic films provided with electroconductivity by coating, vapor deposition or lamination of films of metals such as aluminum, palladium and gold (including alloys) incorporating electroconductive compounds such as electroconductive polymers and indium oxide.

The photoreceptor of the present invention may incorporate organic amines for improving the charge generation function of CGM, with preference given to secondary amines.

Such secondary amines include dimethylamine, diethylamine, dipropylamine, diisopropylamine, dibutylamine, diisobutylamine, diamylamine, diisoamylamine, dihexylamine, diixohexylamine, dipentylamine, diisopentylamine, dioctylamine, diisooctylamine, dinonylamine, diisononylamine, didecylamine, diisodecylamine, dimonodecylamine, diisomonodecylamine, didodecylamine and diisododecylamine.

The amount of these organic amines added is preferably not more than 1 mol, more preferably 0.2 to 0.005 mol per mol of CGM. It is preferable to add the organic amine to CGL.

In the present invention, for improving sensitivity, reducing residual potential, mitigating fatigue during repeated use and other purposes, the CGL may incorporate one or more electron recipient substances.

Examples of electron recipients which can be used for these purposes include succinic anhydride, maleic anhydride, diibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-nitrobenzene, m-dinitrobenzene, 1,3,5-trinitrobenzene, p-nitrobenzonitrile, picryl chloride, quinone chlorimide, chloranil, bromanil, dichlorodicyano-p-benzoquinone, anthraquinone, dinitroanthraquinone, 2,7-dinitrofluorenone, 2,4,7-trinitrofluorenone, 2,4,5,7-tetranitrofluorenone, 9-fluorenylidene[dicyanomethylenemalonodinitrile], polynitro-9-fluorenylidene[dicyanomethylenemalonodinitrile], picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid and other compounds of high electron affinity.

The amount of electron recipient added is 0.01 to 200 parts by weight, preferably 0.1 to 100 parts by weight per 100 parts by weight of the charge generation material.

The electron recipient substance may be added to CTL. The ratio of electron recipient added to CTL is 0.01 to 100 parts by weight, preferably 0.1 to 50 parts by weight per 100 parts by weight of the CTM.

The photoreceptor of the present invention may also incorporate an antioxidant, an ultraviolet absorbent and other additives added as necessary to protect the light-sensitivity, and also a dye for correction of color sensitivity.

Various photoreceptor layer configurations are known. The photoreceptor of the present invention is a photoreceptor of the multiple-layered functional separation type, in which BAL is formed on an electroconductive support, CGM-containing CGL is formed thereon, and CTL containing a charge transport material (CTM) formed thereon. Auxiliary layers such as an adhesive layer may be formed between the structural layers and the electroconductive support, and a protective layer may be formed on the uppermost layer.

The barrier layer (BAL) relating to the present invention is made of a copolymerized polyamide resin. This copolymerized polyamide resin, preferably soluble in alcohol, is dissolved in an alcohol solvent and coated on the support or adhesive layer to form BAL.

Such copolymerized polyamide resins are nylon resins such as nylon 6, nylon 66, nylon 610, nylon 11 and nylon 12.

Alcohol solvents for dissolving the copolymerized polyamide resin include methyl alcohol, ethyl alcohol and butyl alcohol.

CGL can be formed by coating a coating solution, prepared as directed below, on an electroconductive support directly or via BAL formed on the support via an adhesive layer as necessary.

1) A solution of the above-described CGM in an appropriate solvent, with a binder resin also added and dissolved as necessary.
2) A dispersion of the above-described CGM in a dispersant, prepared as fine grains (grain size preferably not more than 5 μm, more preferably not more than 1 μm) using a ball mill, sand grinder or the like, with a binder resin and/or CTM added and dissolved as necessary.

Solvents or dispersants used to form CGL include, but not limited to, butylamine, diethylamine, ethylenediamine, isopropanolamine, triethanolamine, triethylenediamine, N,N-dimethylformamide, acetone, methyl ethyl ketone, methyl isobutyl ketone, cyclohexanone, benzene, toluene, xylene, chloroform, 1,2-dichloroethane, 1,2-dichloropropane, 1,1,2-trichloroethane, 1,1,1-trichloroethane, trichloroethylene, tetrachloroethane, dichloromethane, tetrahydrofuran, dioxane, methanol, ethanol, isopropanol, ethyl acetate, butyl acetate, dimethyl sulfoxide and methyl cellosolve.

The structural layers of the photoreceptor must be uniformly coated on the support. For thick CGL, in particular, coating thickness uniformity is strongly demanded.

However, suspensions of fine solid grains in resin solutions generally have many problems concerning uniform coating because of their rheology; thixotropic or pseudoplastic fluidity often occurs depending on suspensate dispersibility in suspending medium, compatibility, grain size relationship, viscosity and other factors, which variously hamper coating operation.

The fluidity of the coating solution is preferably near that of the Newtonian fluid, which allows easy control of coating.

With respect to CGL, which requires particularly uniform layer thickness, requirements for suspensate and the suspending medium resin solution are set to obtain a fluidity $\tau=\tau_0+\eta D^B$ ($0.7 \leqq B \leqq 1.3$).

Specifically, a CGL coating solution of good coatability was obtained by dissolving a polyvinyl butyral resin of not lower than 70 mol % of the degree of butyralation in a ketone solvent and choosing a BIPP which is easily prepared as fine grains and which offer good grain uniformity, good dispersion uniformity in the resin solution and good dispersion stability for CGL to obtain a exponent B of $0.7 \leqq B \leqq 1.3$ for D in the above equation and adjusting the $\eta$ value. Here, I represents shear stress, D represents shear rate, $\eta$ represents coefficient of viscosity, $\tau_0$ represents the value for $\tau$ when D is 0, and B represents the exponent of D.

The electroconductive support for the electrophotographic photoreceptor is based on a particular aluminum alloy containing 0.1 to 3% by weight of magnesium (Mg), 0.01 to 0.8% by weight of silicon (Si) and 0.01 to 0.4% by weight of iron (Fe), preferably 0.2 to 2.0% of Mg, 0.02 to 0.6% of Si and 0.02 to 0.2% of Fe. Additionally, not more than 0.01% by weight copper (Cu) and not more than 0.1% by weight of other metals may be contained.

The additive magnesium (Mg) is effective in improving the cutting property and mechanical strength. Also, the Al-Mg metal compound does not cause imaging failures because it shows entire surface corrosion rather than pitting corrosion. However, these effects are not obtained well if the Mg content is lower than 0.1% by weight. If the Mg content exceeds 3% by weight, crystallization of Mg and Si, intergranular corrosion and stress corrosion are accelerated.

The additive silicon (Si) is effective in improving the mechanical strength and corrosion resistance. However, these effects are not obtained well if the Si content is lower than 0.01% by weight. If the Si content exceeds 0.8% by weight, coarse Si grains separate, causing surface failures.

The additive iron (Fe) forms an Fe-Al or Fe-Al-Si intermetallic compound with the copresent aluminum and silicon, appearing as hard spots in the aluminum matrix. As the iron content increases above 0.4%, the number of these hard spots increase rapidly, having adverse effects in mirror finish cutting etc. The iron content in the aluminum alloy for the present invention is therefore preferably not more than 0.4%, more preferably not more than 0.2%.

The content ratio values for additives to the base-constituting aluminum alloy given in this specification are obtained using a wavelength dispersion type fluorescent X-ray analyzer, System 3080, produced by Rigaku Denki.

This base is preferably subjected to a hydration oxidation treatment. In this case, each of the iron and silicon contents in the alloy are not more than 0.2% by weight, and the total content of the alloy components other than iron and silicon which are lower than aluminum in ionization tendency is not more than 0.2% by weight.

Alloy components such as iron and silicon form an aluminum alloy during base processing and tend to form a crystal unlikely to be coated by the hydrated oxidized aluminum layer. On the other hand, magnesium is known to form no crystal because it forms a solid solution with aluminum. It is also known that in the presence of a metal higher than aluminum in ionizing tendency, aluminum dissolves easily to suppress the hydration oxidation reaction, and that in the absence of a metal lower than aluminum in ionizing tendency, aluminum does not dissolve and contrarily promotes the hydration oxidation reaction.

The above-described light-sensitive layer may incorporate anti-deterioration agents such as oxidants and light stabilizers for improving storage stability, durability and weather resistance. Examples of compounds used for these purposes include biphenyl, terphenyl, diphenyl ether, diphenyl carbonate, phenyl benzoate, diphenyl phthalate, chromanol derivatives such as tocopherol and ether compounds or ester compounds thereof, polyarylalkane compounds, hydroquinone derivatives and mono- and di-ether compounds thereof, benzophenone derivatives, benzotriazole derivatives, thioether compounds, phosphonates, phosphites, phenylenediamine derivatives, phenol compounds, hindered phenol compounds, linear amine compounds, cyclic amine compounds and hindered amine compounds. Particularly effective compounds are exemplified by hindered phenol compounds such as IRGANOX 1010 and IRGANOX 565 (both produced by Ciba-Geigy) and Sumilizer BHT and Sumilizer MDP (both produced by Sumitomo Chemical) and hindered amine compounds such as Sanol LS-2626 and Sanol LS-6221LD (both produced by Sankyo Co., Ltd.). The weight ratio of these compounds and the carrier transport material is normally 0.001:1 to 0.1:1, preferably 0.01:1 to 0.1:1.

In the present invention, an interlayer (barrier layer) may be present between the hydrated oxidized aluminum layer and the charge generation layer, and its thickness is normally 0.01 to 15 μm, preferably 0.05 to 3 μm.

If the interlayer thickness is less than 0.01 μm, charge injection from the base to the light-sensitive layer is difficult to prevent, and the photoreceptor is likely to have pinholes due to surface ruggedness of the base. If the interlayer thickness exceeds 15 μm, the residual potential in the light-sensitive layer cannot be eliminated efficiently.

After the aluminum base tube is washed, a hydrated oxidized aluminum layer can be formed on the aluminum base by dipping it in water having a resistivity of not lower than 10 MΩcm, preferably not lower than 17 MΩcm and a temperature of 60° to 90° C., preferably 70° to 80° C. for a given period of time, preferably at least 20 seconds. Aluminum base washing before formation of the hydrated oxidized layer may be achieved by the following methods:

1) Washing with liquid jets (jet washing)
2) Washing with rubbing element (rubbing washing)
3) Washing in combination with irradiation with >300 run UV (UV washing)
4) Ultrasonic and steam washing with organic solvent
5) Washing using a spongy roller In the present invention, aqueous washing is preferably used.

This rotary drum base of aluminum alloy is usually finished by surface cutting using a cutting liquid. This cutting liquid is used to obtain cooling, lubrication, washing and other actions. Specifically, petroleum, polybutene, lamp oil, kerosene, etc. are used.

To prevent imaging failures, the base surface is washed by contact washing means using brushes, abrasives, etc. after the base is subjected to cutting finish.

If an uneven region occurs in the charge generation layer due to the presence of foreign matter on the base surface, the obtained image has white dots. Even when the base has been washed to such extent that the presence of foreign matter is almost negligible, minute white spots can appear on the image under high temperature conditions. This is attributable to free carrier injection from the electroconductive base to the charge generation layer. To suppress this free carrier injection, a charge injection preventive layer (barrier layer) of desired resistivity is often provided at the interface between the base and the charge generation layer. The barrier layer is exemplified by resin films of relatively low resistivity, represented by polyamide coated on base, and anode oxidized film formed by anode oxidation of the surface of the aluminum alloy base. The anode oxidized film of aluminum alloy permits film properties, resistivity and other factors by film forming conditions (anode oxidation conditions, pore sealing conditions). Although conditions of forming an anode oxidized film suitable as a barrier layer is limited to a relatively narrow range, the resulting film has traditionally been commonly used since it is suitable as a barrier layer and hard, stable and easy to handle.

With respect to the base consisting of an aluminum alloy whose surface has been treated using cutting oil as described above, the cutting oil must be thoroughly removed by washing with chlorofluorocarbons such as freon 11, freon 112 and freon 113 and chlorine solvents such as trichloroethylene, 1,1,1-trichloroethane, perchloroethylene and methylene chloride. The use of large amounts of these solvents are problematic as to environmental pollution and occupational safety because it involves the risk of ozone layer depletion and carcinogenicity.

With this in mind, aqueous washing with aqueous detergent solutions are being considered as substitutes for organic solvent detergents. However, when aqueous washing with a detergent solution is adopted to wash the base surface after cutting finish, washing efficiency decreases inevitably, in comparison with organic solvent washing, so that cutting dust produced during surface finish of the base, environmental foreign matter, cutting oil, etc., which can cause imaging failures, remain on the base surface. When a conventionally used pigment is used as a charge generation material in an aluminum base after such aqueous washing, the resulting image has white dots and local density reduction. Moreover, charge potential and sensitivity decrease, and residual potential increases further in repeated image formation. There is a need for an aluminum base material which shows no significant imaging failures even when the base is subjected to aqueous washing after cutting finish and which has high sensitivity and good repeatability.

With respect to the above-described anode oxidation treatment of aluminum, the occurrence of minute white dots on the image can be decreased to some extent by forming a barrier layer on the electroconductive aluminum base by anode oxidation. However, all attempts to variously changing the film properties of the alumite layer (anode oxidized film) to obtain further improvement failed to yield satisfactory results.

The another object of the present invention is to provide a photoreceptor base subjected to aqueous washing posing no problems of environmental protection or occupational hygiene based on the advantages of aluminum alloy of low cost, light weight and easy workability, or a photoreceptor whose performance has been improved by anode oxidation, which has no imaging failures, high sensitivity and good repeatability.

Provided that the charge generation material of the present invention, represented by formula I or II is incorporated in the charge generation layer, satisfactory results are obtained even when the electroconductive support is a aluminum base subjected to aqueous washing or anode oxidation.

Aqueous washing according to the present invention is performed on an aluminum base subjected to surface treatment by a conventional method.

Aqueous washing normally consists of three processes: washing, rinsing and drying for removing cutting oil, aluminum cutting dust, etc. from the base tube surface, for removing the detergent solution and for removing the water, respectively.

Various methods have been attempted for the drying process, since uniform water removal is very difficult, including hot blow drying, air rolling blow drying and warm water drawing-up drying.

Of these drying methods, warm water drawing-up drying is most preferable because it allows perfect and uniform water removal.

A preferred mode of aqueous washing is described below.

Washing

An aqueous detergent solution is used to remove the cutting oil, aluminum cutting dust, etc. from the surface of the electroconductive base.

Available water removing methods are as follows: immersion in an aqueous detergent solution (including simple dipping, base tube rotation and vibration), Ultrasonic washing (US washing)

Sonicator setting positions: Chamber's bottom, side, slope and combinations thereof.

Ultrasound types: 28 KHz, 40 KHz, simultaneous multiple frequency, multiple frequency alternative oscillation and others.

Brush or sponge rubbing washing

A preferred sponge is the sponge described in Japanese Patent O.P.I. Publication No. 257456/1991 (Belclean, commercially available from Kanebo Ltd.)

It is common practice to combine detergent washing and US washing in the first chamber and detergent washing, sponge rubbing and detergent shower in the second chamber.

Various detergents are commercially available. Some examples are given below.

| Manufacturer | Brand name | pH |
|---|---|---|
| Lion Corporation | Sunwash FM-10 | 6.8 (10%) |
| | Sunwash* LH-1 | 11.8 (10%) |
| Kao Corporation | Cleanthrough 750L | 6.1 (10%) |
| | Scorerol 700 Conc | 5.2 (10%) |
| | Screenthrough LC841 | 8.6 (10%) |
| Dai-ichi Kogyo Seiyaku | BE-CLEAR CW-5524 | 12.1 (10%) |
| Shimada Rika Kogyo K.K. | A-88 | 9.1 (1 wt %) |
| Sonic Fellow | SE-40 | 9.9 (10%) |
| | SE-110 | 3.25 (10%) |
| | SE-115 | 10.4 (10%) |
| | SE-120 | 9.0 (10%) |
| | SE-70 | 7.0 (10%) |
| Henkel Hakusui Corporation | P3almecoM51 | 12.2 (10%) |
| Diafloc | Orkite Aluminum Cleaner SN | 8.4 (10%) |

Alkaline detergents surpass neutral detergents in deterging power.

Rinsing

The detergent is removed from the aluminum base.

Detergent removal is achieved in the same manner as the washing process. From the viewpoint of prevention of readhesion of dirt, noncontact methods such as dipping and ultrasonication are preferred (brushes and sponges undesirable).

The rinsing water for dipping is ion/particle-free water generally known as pure water or superpure water.

Drying

The water is removed from the surface of the aluminum base.

Although water removal can be achieved by hot blow drying, air blow drying, warm water drawing-up drying and other methods, warm water drawing-up drying is preferred.

Warm water drawing-up drying is achieved by dipping the aluminum base in warm water for several to some dozens of seconds until it reaches the same temperature as the warm water, then vertically drawing up the aluminum base gradually at constant speed and drying the surface water film by the thermal capacity of the aluminum base. Although the drawing speed is normally 0.1 to 2.0 cm/sec, preferably 0.5 to 1.0 cm/sec. Drying is facilitated as the warm water temperature is increased, but too high warm water temperatures can cause uneven drying due to steam. In the present invention, the warm water temperature in the drying process is preferably 60° to 90° C., more preferably 70° to 80° C.

The water used to wash the base tube preferably meets the following requirements:

Resistivity: Not lower than 10 MΩcm, preferably not lower than 17 MΩcm.

Fine grains: Number of 0.2 μm or greater fine grains not more than 100 grains/ml, preferably not more than 30 grains/ml Viable cells: Not more than 0.1 colony/ml In the present invention, the anode oxidation treatment is carried out after a pretreatment for smoothing the surface of the aluminum base by cutting. Decreasing for this treatment may be achieved with any decreasing agent, whether acidic, alkaline or neutral, and with any etching agent, whether acidic or alkaline.

Although the anode oxidation treatment can be carried out by ordinary methods without limitation, so-called the sulfuric acid method is preferred because it is economically excellent with low chemical cost and is excellent in productivity with rapid film formation. Basically, sulfuric acid is not limitative; oxalic acid, phosphoric acid, chromic acid and other acids may be used singly or in combination. Also, electrolysis may be achieved by such methods as the constant current method, constant voltage method, pulse method and double-stage electric field method.

Of the thus-formed anode oxidized films, porous ones are often chemically active and sometimes insufficient in film strength, corrosion resistance, stain resistance and other properties, so that it is desirable to inactivate them by pore sealing treatment. Preferred pore sealing treatments include hydration pore sealing with boiling water or steam and inorganic material pore sealing with aqueous solution of heavy metals.

The thickness of the anode oxidized film is normally 0.5 to 50 μm, preferably 2 to 20 μm.

In the present invention, the thickness of the interlayer serving as a barrier layer is normally 0.01 to 5 μm, preferably 0.05 to 3 μm. If this thickness is lower than 0.01 μm, charge injection from the base to the light-sensitive layer is not prevented and pinholes are likely to occur in the light-sensitive layer due to surface ruggedness on the base if this thickness exceeds 5 μm, efficient removal of residual potential in the light-sensitive layer is hampered.

The photoreceptor has high durability in repeated use and stable charge potential, sensitivity, dark decay, white paper potential and residual potential, undergoing no image quality deterioration due to changes in these properties.

The photoreceptor of the present invention is preferably used in an image forming method in which a roller charger is used in contact therewith to charge it. It is also capable of forming an image of high quality by developing an electrostatic latent image formed thereon with a toner having a number-average primary grain size of not more than 9 μm.

Roller chargers and charging methods are described below.

Charging may be achieved by any of the direct current charging method, in which a direct current is applied to a roller, and the dielectric charging method, in which an alternating current is applied to a roller.

Frequency f for the voltage applied in the dielectric charging method may be optionally chosen, and to prevent strobing, or stripes, an appropriate frequency can be chosen according to the relative speed of the roller element and photoreceptor element. This relative speed may be determined by the size of the contact area between the roller element and the photoreceptor element. The roller consists of a core metal and an electroconductive elastic layer formed around the core metal. The electroconductive elastic layer is preferably made of an elastic electroconductive rubber, specifically a polymeric material such as neoprene, EPDM rubber, Hypalon rubber, nitrile rubber, polyurethane rubber (polyester type), polyurethane rubber (polyether type), silicone rubber, *Viton/fluororel* rubber or epichlorohydrin rubber, or a similar material having a direct current volume resistivity of $10^3$ to $10^7$ Ωcm after appropriate addition of graphite and other electroconductive additives. These materials are chosen to meet various requirements such as deformability upon contact with the photoreceptor element, as well as wear resistance, possibility of production within tolerance range and economy.

On the outside of these electroconductive rubber layers, there may be formed a releasable film to prevent adhesion of residual toner etc. on the photoreceptor surface to the charging element.

The releasing film is preferably polyvinylidene fluoride, polyvinylidene chloride, nylon resin or the like.

The developer, toner and developing conditions for the present invention are described below.

The developer for the present invention is a two-component developer excellent in fluidity and frictional chargeability and hence in developability.

The two-component developer preferably comprises a nonmagnetic small-grain toner and magnetic carrier grains.

For obtaining such a nonmagnetic small-grain toner, it is preferable to form insulating grains having a volume resistivity of not lower than $10^{14}$ Ωcm and an average grain size of 2 to 12 μm by mixing a coloring agent such as carbon black at not higher than 20% by weight, and if necessary a charge control agent at not higher than 5% by weight, to the thermoplastic or thermosetting resin described below, melting, kneading, cooling and milling them and classifying the grains, with heat treatment as necessary. The above-described coloring agent and other additives, contained in a binder resin monomer, may be polymerized while stirring, to form a spherical toner.

Examples of the binder resin used in the above-described toner include addition polymerization resins such as styrene resin, styrene-acrylic resin, styrene-butadiene resin and acrylic resin, condensation polymerization resins such as polyester resin, polycarbonate resin, polyamide resin, polysulfonate resin and polyurethane resin, and epoxy resin.

Examples of monomers for forming addition polymerization resins, in particular, include styrenes such as styrene, o-methylstyrene, m-methylstyrene, p-methylstyrene and 3,4-dichlorostyrene; ethylenic unsaturated monoolefins such as ethylene, propylene, butyrene and isobutyrene; vinyl halides such as vinyl chloride, vinylidene chloride, vinyl bromide and vinyl fluoride; vinyl esters such as vinyl acetate, vinyl propionate, vinyl benzoate and vinyl butyrate; o-methylene aliphatic monocarboxylic acid esters such as methyl acrylate, ethyl acrylate, butyl acrylate, isobutyl acrylate, propyl acrylate, octyl acrylate, dodecyl acrylate, lauryl acrylate, 2-ethylhexyl acrylate, octyl methacrylate, stearyl methacrylate, phenyl methacrylate, dimethylaminoethyl methacrylate and diethylaminoethyl methacrylate; acrylic or methacrylic acid derivatives such as acrylonitrile, methacrylonitrile and acrylamide; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; monoolefinic monomers such as vinylnaphthalene; and diolefinic monomers such as propadiene, butadiene, isoprene, chloroprene, pentadiene and hexadiene. These monomers may be used singly or in combination.

Examples of monomers for forming condensation polymerization resins include ethylene glycol, triethylene glycol and 1,3-propylene glycol.

Charge control agents are described in Japanese Patent O.P.I. Publication Nos. 88743/1984, 88745/1984, 76256/1984, 78362/1984, 228259/1984 and 124344/1984 for negative charge control agents and in Japanese Patent O.P.I. Publication Nos. 9456/1976, 204851/1984, 204850/1984 and 177571/1984 for positive charge control agents.

To prevent the offset phenomenon caused by toner adhesion to the fusing roller, a low molecular polyolefin (e.g., polypropylene, polyethylene, wax) may be added at 0 to 5% by weight relative to the binder content.

Also, to provide developer fluidity and other charge control properties (negative), a hydrophobic silica may be externally added at 0 to 2.0% by weight relative to the toner content.

To achieve image formation at high resolution, the toner of the present invention is prepared as grains having an average grain size of 2 to 9 μm, preferably 3 to 7 μm at its preparation.

If the volume-average grain size of the above-described toner is less than 2 μm, image fogging is likely, and toner scattering occurs. If the volume-average grain size exceeds 9 μm, the desired resolution cannot be obtained. In short, in the present invention, image formation at the desired resolution cannot be achieved unless the toner grain size falls within the above range, representing an essential requirement of the present invention.

In reversal development, normal or noncontact, according to the present invention, the direct current electric field intensity is normally $1\times10^3$ to $1\times10^5$ V/cm, preferably $5\times10^3$ to $1\times10^4$ V/cm. Electric field intensities below $10^3$ V/cm result in a lack of developability, thus hampering the obtainment of sufficient image density. Electric field intensities above $10^5$ V/cm result in rough image quality, thus causing fogging.

The alternating current bias is normally 0.5 to 4 KV (pp), preferably 1 to 3 KV (p—p), and the frequency is normally 0.1 to 10 KHz, preferably 2 to 8 KHz.

If the alternating current bias is less than 0.5 KV (p—p), the carrier-attached toner fails to detach, resulting in unsatisfactory noncontact development and a lack of image density. If the alternating current bias exceeds 4 KV (p—p), the carrier in the developer scatters, causing carrier adhesion to the photoreceptor.

If the alternating current bias frequency is less than 0.1 KHz, the carrier-attached toner fails to detach, resulting in unsatisfactory development and a lack of image density. If the alternating current bias frequency exceeds 10 KHz, the toner fails to follow the electric filed change, resulting in poor development and image density reduction.

The volume-average grain size of the above-described toner was determined using Coulter Counter TAII, produced by coulter Electronics.

To prevent bias voltage leakage resulting in latent image charge loss, the carrier's resistivity is normally not lower than $10^8$ Ωcm, preferably not lower than $10^{13}$ Ωcm, and more preferably not lower than $10^{14}$ Ωcm.

The specific resistivity of the carrier or toner can be obtained by tapping the grains in a container having a cross sectional area of 0.5 $cm^2$, then exerting a load of 1 $kg/cm^3$ thereon, applying a voltage resulting in an electric field of $10^2$ to $10^5$ V/cm between the load and the base electrode, reading the amperage and making calculations. In this determination, the thickness of the carrier or toner grain layer is about 1 mm. The carrier for the present invention is preferably made spherical to improve developer fluidity and to improve carrier-toner frictional chargeability and to suppress blocking between carrier grains or between the carrier and the toner.

For obtaining such a spherical carrier in the case of a resin-coated carrier, for example, magnetic grains, previously made spherical, are coated with a thermoplastic or thermosetting resin to a thickness of 0.1 to 2 μm (0.5 to 5% by weight relative to the carrier weight). In the case of resin-dispersed carrier, fine grains of magnetic powder are dispersed in a resin at 30 to 70% by weight and then thermally treated to obtain spherical grains, or spherical grains may be directly produced by spray drying.

The above-described two-component developer incorporates the above-described carrier and toner in a weight ratio of 98:2 to 85:15, with fluidizing agents such as hydrophobic silica, colloidal silica and silicone varnish, and cleaning aids such as metal salts of fatty acid and fluorine surfactants added at 0.1 to 3.0% by weight relative to the toner content as necessary.

The image forming method of the present invention is hereinafter described.

Figure 2:
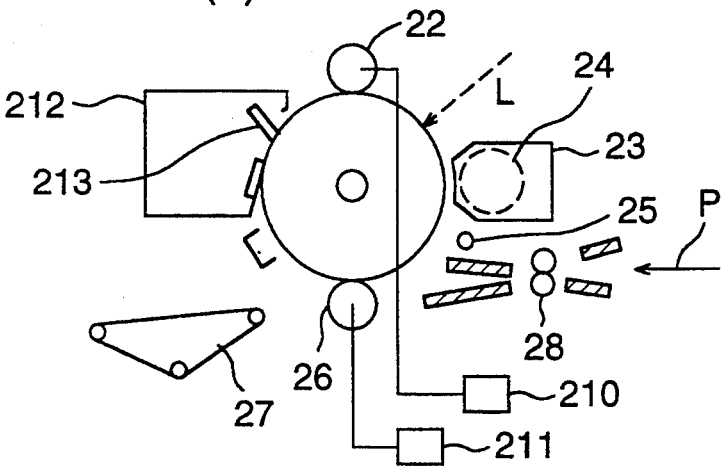
FIGS. 2(*a*) and 2(*b*) are side views of an example of image forming apparatus based on roller charging.
Figure 2:
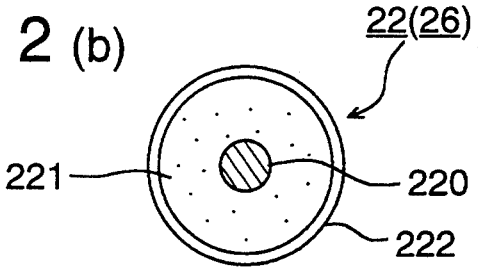

FIGS. 2(*a*), 2(*b*) and 3 are examples of image forming apparatuses used for the image forming method of the present invention.

Figure 3:
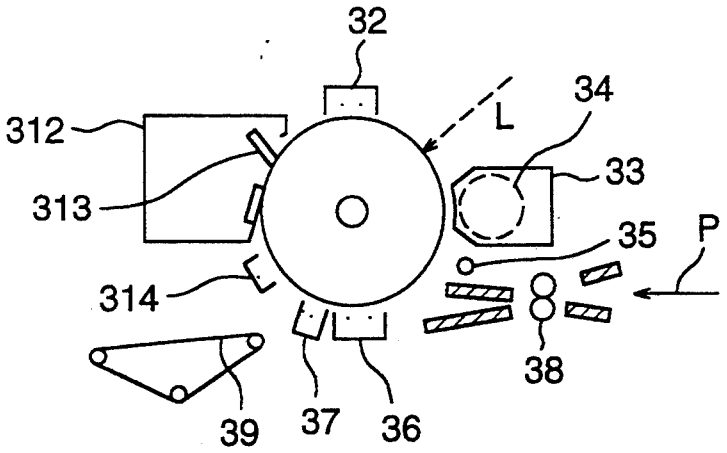
FIG. 3 is a side view of an example of image forming apparatus based on corona charging.

The image forming apparatus of FIGS. 2(*a*) and 2(*b*) are of such a mode that ozone production is prevented and a roller charger is used for electrostatic latent image formation and toner transfer. The image forming apparatus of FIG. 3 is of such a mode that charging is achieved by corona discharge. Both exhibits good performance when the toner relating to the present invention is used.

In FIG. 2 (*a*), an electrostatic latent image is formed on photoreceptor drum 21 charged by charging roller 22. This electrostatic latent image is then developed to a toner image by developing sleeve 24, i.e., the developer retainer of developer unit 23 arranged close to photoreceptor drum 21. Before transfer, photoreceptor drum 21 is discharged by discharging lamp 25, after which the toner image is transferred onto copying paper P, transported from the paper feed cassette by transport roller 28, by transfer electrode 26. After transfer, copying paper P is detached from photoreceptor drum 21, after which it is sent to the fuser by transport belt 27, where the toner image is fused on copying paper P by heat rollers and compression rollers.

Charging roller 22 (and transfer roller 26) is applied with a bias voltage comprising DC and AC components by power source 210 (211), and photoreceptor drum 21 charging and toner image transfer to transfer paper P are achieved in a condition of very low ozone production. The bias voltage normally consists of a DC bias of ±500 to 100 V and an AC bias of 100 Hz to 10 KHz and 200 to 3500 V (p-o).

Charging roller 22 and transfer roller 26 are revolved, directly or via a slave gear, in contact with photoreceptor drum 21.

The pressure on photoreceptor drum 21 is 10 to 100 g/cm, while the roller rotation rate is set at 1 to 8 times the peripheral speed of photoreceptor drum 21. As illustrated in FIG. 2(*b*), charging roller 22 (and transfer roller 26) comprises core metal 220 and a rubber or sponge layer 221 of electroconductive chloroprene rubber, urethane rubber or silicone rubber arranged around core metal 220, preferably with 0.01 to 1 μm protective layer 222 of releasable fluorine resin or silicone resin formed as the uppermost layer.

After transfer, photoreceptor drum 21 is cleaned by blade 213 of cleaner 212 to be ready for the next image formation.

In the image forming apparatus illustrated in FIG. 3, an electrostatic latent image is formed on photoreceptor drum 31 charged by corona charger 32 upon imagewise exposure. This electrostatic latent image is then developed to a toner image by developing sleeve 34, i.e., the developer retainer of developer unit 33 arranged close to photoreceptor drum 31. Before transfer, photoreceptor drum 31 is discharged by discharging lamp 35, after which the toner image is transferred onto copying paper P, transported from the paper feed cassette by transport roller 38, by transfer electrode 36. After transfer, copying paper P is detached from photoreceptor drum 31 by separation electrode 37, after which it is sent to the fuser by transport belt 39, where the toner image is fused on copying paper P by heat rollers and compression rollers.

The developer unit contains a developer containing a toner of not more than 7 μm in average grain size, the light-sensitive layer of photoreceptor drum 31 contains BIPP of general formula I and/or II as CGM.

After transfer, the photoreceptor drum surface is discharged using discharger 314, after which it is cleaned with blade 13 of cleaner 312 to be ready for the next image formation.

EXAMPLES

The present invention is hereinafter described in more detail by means of the following examples.

An aluminum base of 80 mm diameter and 355.5 mm length was prepared as a support.

Example 1

50 g of copolymerized polyamide resin (CM8000, produced by Toray Industries, Inc.) was dissolved in a mixed solvent of 900 ml of methanol and 100 ml of 1-butanol. The aluminum support was dipped in, and pulled up from, this solution to coat BAL of 0.3 μm thickness.

To a solution of 3 g of polyvinyl butyral resin (Eslec BL-2, produced by Sekisui Chemical) in a mixed solvent of 300 ml of MEK and 50 ml of cyclohexanone, 6 g of Example Compound A-1 was added, followed by 5 hours of dispersion using a sand grinder, to yield a CGL coating solution, which was dip coated on the BAL to form a CGL of 0.3 μm thickness.

150 g of polycarbonate resin (Panlite TS-2050, produced by Teijin Chemicals, Ltd., Mw 145000) and 110 g of the following T-1 as CTM were dissolved in 1000 ml of dichloromethane. This solution was dip coated on CGL, followed by drying at 100° C. for 1 hour, to yield a CTL of 20 μm thickness.

Example 2

BAL was formed in the same manner as in Example 1, except Chat the polyamide resin was replaced with copolymerized polyamide resin (Elvamide 8061, produced by Du Pont).

The CGL and CTL were treated in the same manner as in Example 1 to yield a photoreceptor.

BAL was formed in the same manner as in Example 1, and the following CGL and CTL were formed.

CGL was formed in the same manner as in Example 1, except that the polyvinyl butyral resin Eslec BL-S was replaced with the polyvinyl butyral resin Eslec BH-S, produced by Sekisui Chemical, and the solvent replaced with methyl ethyl ketone.

CTL was formed in the same manner as in Example 1, except that the solvent was replaced with tetrahydrofuran and CTM replaced with the following T-2.

Example 4

BAL and CGL were formed in the same manner as in Example 3, and the above-described CTL was formed thereon in the same manner as in Example 3, except that the solvent was replaced with chloroform and CTM replaced with the following T-3, to yield a photoreceptor.

Example 5

BAL and CGL were formed in the same manner as in Example 3, and CTL was formed thereon in the same manner as in Example 1, it except that the polycarbonate resin was replaced with IUPIRON PCA-400 (MW 115000), produced by Mitsubishi Gas Chemical Co., Inc., to yield a photoreceptor.

Example 6

BAL and CGL were formed in the same manner as in Example 3, and CTL was formed thereon in the same manner as in Example 1, except that the polycarbonate resin was replaced with IUPIRON PCZ-800 (Mw 245000), produced by Mitsubishi Gas Chemical Co., Inc., to yield a photoreceptor.

Comparative Example 1

BAL was formed in the same manner as in Example 1, except that the polyamide resin was replaced with modified polyamide resin (X-1874M, produced by Daicel Huls Ltd.). CGL and CTL was formed thereon in the same manner as in Example 1 to yield a photoreceptor.

Comparative Example 2

BAL and CGL were formed in the same manner as in Example 1, and CTL was formed in the same manner as in Example 1, except that the polycarbonate resin was replaced with IUPIRON PCZ-300 (Mw 850000), produced by Mitsubishi Gas Chemical Co., Inc., and CTM was replaced with the following T-3.

T-1

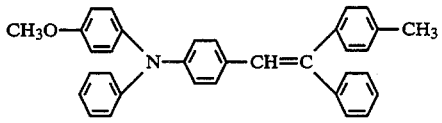

T-2

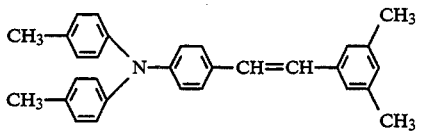

T-3

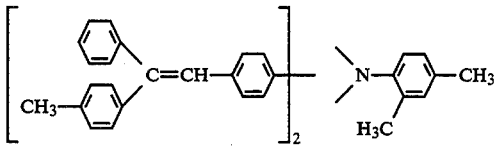

Comparative Example 3

BAL was formed in the same manner as in Example 1, except that the polyamide resin was replaced with modified polyamide resin (Luckamide 5003, produced by Dainippon Ink and Chemical Mfg.). CGL and CTL were formed thereon in the same manner as in Example 1 and Comparative Example 2, respectively.

Comparative Example 4

BAL and CTL were formed in the same manner as in Example 1, and CTL was formed thereon in the same manner as in Example 1, except that CGM was replaced with the following G-1 and the polyvinyl butyral resin replaced with the polyvinyl butyral resin Eslec BX-1, produced by Sekisui Chemical.

Comparative Example 5

BAL and CTL were formed in the same manner as in Example 1, and CGL was formed thereon in the same manner as in Example 1, except that CGM was replaced with the following G-2 and the solvent was replaced with methyl isopropyl ketone.

G-1

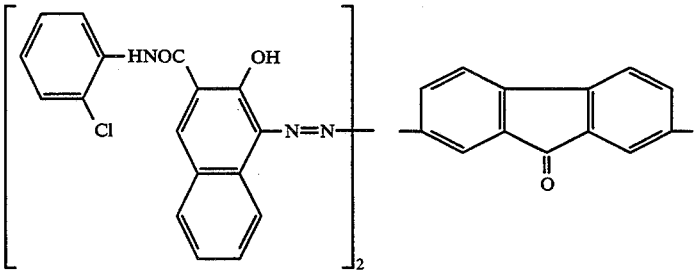

-continued

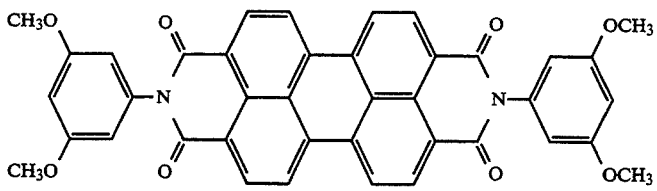

G-2

Comparative Example 6

BAL was formed in the same manner as in Example 1, and CTL was formed thereon in the same manner as in Example 1, except that the polyvinyl butyral resin was replaced with the polyvinyl butyral resin Eslec BH-S, produced by Sekisui Chemical and the solvent was replaced with methyl ethyl ketone and CTL was formed in the same manner as in Example 1, except that the polycarbonate resin replaced with IUPIRON PCZ-200 (Mw 52000), produced by Mitsubishi Gas Chemical Co., Inc.

Comparative Example 7

BAL and CGL were formed in the same manner as in Example 1 and Comparative Example 6, respectively, and CTL was formed in the same manner as in Example 1 except that the solvent was replaced with dichloroethane.

The photoreceptor samples thus obtained were tested as to various properties as follows:

Each photoreceptor sample was used to take 100000 copies on U-Bix 4045. "100 kc" is used for 100000 copies. In this actual copying test, black paper potential, white paper potential and residual potential Vr (v) were determined just after the 1st and 100000th copies were taken. Also determined was the loss of layer thickness (μm/100 kc).

White paper potential Vw(v): Drum surface potential for an original of a density of 0.0.

Black paper potential Vb(V): Drum surface potential for an original of a reflex density of 1.30.

The CTL coating condition was also observed.

The results are given in Table 1.

TABLE 1

| Property | Initial potential | | | potential after 100 kc | | | Loss of layer thick-ness | CTL |
|---|---|---|---|---|---|---|---|---|
| Sample No. | Vb | Vw | Vr | Vb | Vw | Vr | (μm/100 kc) | coatability |
| Example | | | | | | | | |
| 1 | 735 | 40 | 10 | 740 | 60 | 20 | 2.2 | Good |
| 2 | 730 | 30 | 10 | 735 | 55 | 25 | 2.0 | Good |
| 3 | 735 | 45 | 10 | 740 | 80 | 20 | 1.9 | Good |
| 4 | 730 | 40 | 10 | 735 | 85 | 25 | 2.2 | Good |
| 5 | 740 | 50 | 10 | 745 | 75 | 20 | 2.3 | Good |
| 6 | 740 | 35 | 10 | 745 | 75 | 20 | 1.7 | Good |
| Comp. | | | | | | | | |
| (1) | 740 | 70 | 25 | 760 | 150 | 80 | 2.1 | Good |
| (2) | 730 | 35 | 10 | 695 | 120 | 25 | 4.5 | Good |
| (3) | 745 | 75 | 30 | 705 | 135 | 75 | 4.7 | Good |
| (4) | 740 | 80 | 15 | 775 | 165 | 90 | 1.9 | Good |
| (5) | 750 | 220 | 55 | 765 | 305 | 125 | 2.2 | Good |
| (6) | 725 | 45 | 10 | 680 | 135 | 85 | 6.1 | Good |
| (7) | 740 | 30 | 5 | 745 | 50 | 15 | 2.3 | * |

*Note: CGL thickness was uneven due to solution run, with corresponding image density unevenness.

The present invention makes it possible to produce an electrophotographic photoreceptor having high sensitivity and very stable even in long-term use and to produce an electrophotographic photoreceptor having such high sensitivity and high stability and also high productivity using a highly soluble methylene chloride or the like as a CTL solvent.

In Example 1 the molecular weight of polycarbonate of the binder used in the charge transfer layer is varied in the following table. BPZ polycarbonate was used. The resulted phooreceptor was adopted to modified U-Bix 4045 (Product of Konica Corporation) to use roll charger and tested taking 100,000 copies.

| Mw | Surface potential | | | | Loss of layer | |
|---|---|---|---|---|---|---|
| | Initial | | After 100 kc | | | |
| (Thousand) | Vb (V) | Vw (V) | Vb (V) | Vw (V) | thickness | |
| 115 | 753 | 60 | 730 | 85 | 2.6 | No problem |
| 145 | 730 | 65 | 725 | 90 | 2.2 | No problem |
| 245 | 740 | 50 | 745 | 85 | 2.0 | No problem |
| 52 | 725 | 70 | 715 | 145 | 6.3 | *a |
| 85 | 730 | 50 | 710 | 130 | 4.3 | *b |

*aFogging occurred after 60000 copies were taken.
Damage appeared on the photoreceptor and black streak appeared.on papaer after taking 50000 copies. . .
*bFogging occurred after 80000 copies were taken.
Damage appeared on the photoreceptor and black streak appeared.on papaer after taking 60000 copies. . .

Example 7

Photoreceptor samples were prepared by dip coating each of the following coating solutions on an aluminum base of 80 mm diameter and 355.5 mm length.

50 g of copolymerized polyamide resin (CM8000, produced by Toray Industries, Inc.) was dissolved in a mixed solvent of 900 ml of methanol and 100 ml of 1-butanol. The aluminum support was dipped in, and pulled up from, this solution to coat BAL of 0.3 μm thickness.

To a solution of 3 g of polyvinyl butyral resin (Eslec BH-S, produced by Sekisui Chemical, degree of butyralation 70%) in a mixed solvent of 300 ml of MEK and 50 ml of cyclohexanone, 6 g of Example Compound A-1 was added, followed by 5 hours of dispersion using a sand grinder, to yield a CGL coating solution, which was dip coated on the BAL to form a CGL of 0.3 μm thickness. No problems arose in coating.

100 g of polycarbonate resin (Panlite TS-2050, produced by Teijin Chemicals, Ltd.) and 110 g of CTM (the following T-1) were dissolved in 1000 ml of dichloroethane. This solution was dip coated on CGL, followed by drying at 100° C. for 1 hour, to form a CTL of 20 μm thickness to yield a photoreceptor.

Example 8

BAL was formed in the same manner as in Example 7, except that the copolymerized polyamide resin (CM8000, produced by Toray Industries, Inc.) was replaced with modified polyamide resin (Luckamide 5003, produced by Dainippon Ink and Chemical). Next, CGL was formed in the same manner as in Example 7, except that the polyvinyl butyral resin Eslec BH-S was replaced with the polyvinyl butyral resin Eslec BL-S, produced by Sekisui Chemical degree of butyralation 70%. No problems arose in coating.

Next, CTL was formed in the same manner as in Example 1, except that the CTM was replaced with the following T-2.

Example 9

BAL and CTL were formed in the same manner as in Example 7.

CGL was formed thereon in the same manner as in Example 1, except that the solvent was replaced with methyl isopropyl ketone. No problems arose in coating.

Example 10

BAL and CTL were formed in the same manner as in Example 7. CGL was formed thereon in the same manner as in Example 7, except that the butyral resin was replaced with #4000-1 of Denki Kagaku Kogyo (degree of butyralation 75%). No problems arose in coating.

Example 11

BAL and CTL were formed in the same manner as in Example 7. CGL was formed thereon in the same manner as in Example 7, except that the butyral resin was replaced with #5000-A of Denki Kagaku Kogyo (degree of butyralation 80%). No problems arose in coating.

Comparative Example 8

BAL and CTL were formed in the same manner as in Example 7. CGL was formed thereon in the same manner as in Example 7, except that the CGM was replaced with the following C-1. No problems arose in coating.

T-1

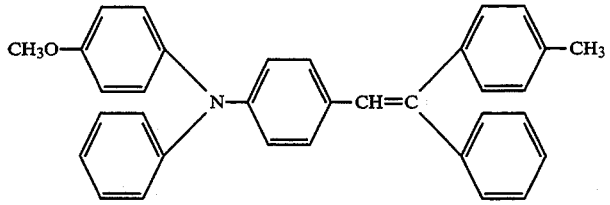

T-2

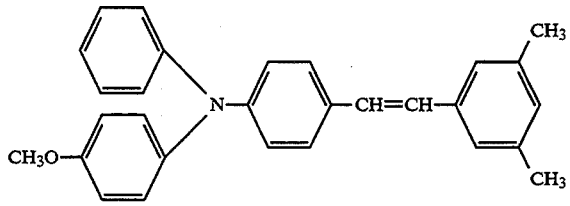

C-1

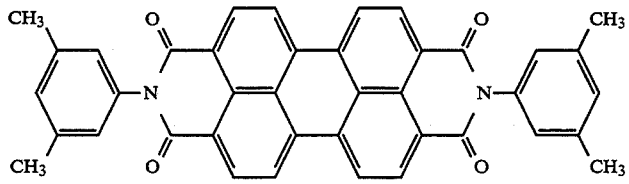

Comparative Example 9

BAL and CTL were formed in the same manner as in Example 7. CGL was formed thereon in the same manner as in Example 7, except that the polyvinyl butyral resin Eslec BH-S (Sekisui Chemical) was replaced with polyester resin (Vyron-200, produced by Toyobo Co., Ltd.). Slight aggregation was seen in the coating film.

Comparative Example 10

BAL and CTL were formed in the same manner as in Example 7. CGL was formed thereon in the same manner as in Example 1, except that the solvent was replaced with dichloroethane. Slight aggregation was seen in the coating film.

Comparative Example 11

BAL was formed in the same manner as in Example 1, except that the copolymerized polyamide resin (CM8000, produced by Toray Industries, Inc.) was replaced with vinyl chloride resin (Eslec MF-10, produced by Sekisui Chemical). CGL was formed thereon in the same manner as in Example 7. Slight aggregation was seen in the coating film. CTL was formed thereon in the same manner as in Example 7.

Comparative Example 12

BAL and CTL were formed in the same manner as in Example 7. CGL was formed thereon in the same manner as in Example 1, except that the butyral resin was replaced with Eslec BM-1, produced by Sekisui Chemical, degree of butyralation 65%.

Each photoreceptor thus obtained was evaluated as to surface potential and image quality, using dry copying machine U-Bix 4045 (produced by Konica Corporation). Surface potential was determined for a black paper original and a white paper original at constant levels of charge current and exposure amount, using a surface voltameter whose probe was attached to the developing apparatus. The same measurement was made after 100000 copies were taken for a durability test.

After exposure amount was set at appropriate level, a reference solid black image, solid white image and intermediate image were copied, and the image samples thus obtained were macroscopically observed for image failures.

The results are given in Table 2, in which B indicates the exponent at shear rate D in equation 1.

The fluidity of the dispersion is measured using, for example, a commercially available Rotovisco RV100 fluidity meter.

Figure 4:
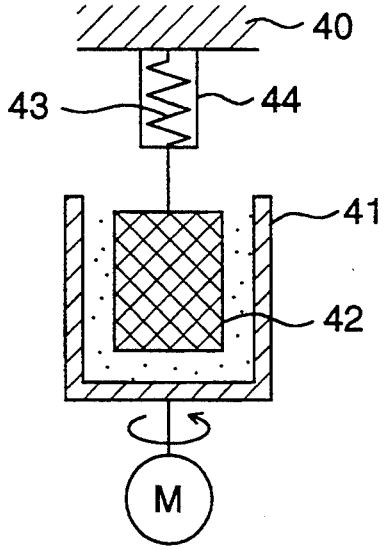
FIG. 4 is an illustration of a fluidity measuring instrument.

This measuring instrument is configured with an outer cylinder revolved by motor M and an inner cylinder dipped in the dispersion in the outer cylinder and supported by the supporting frame (40) via a spring (43), as illustrated in FIG. 4. When the outer cylinder (41) is revolved at shear rate D (1/sec) by motor M, the inner cylinder (42) produces a torque based on the mediating dispersion's coefficient of viscosity $\eta$ (dyne/cm$^2$.sec), which in turn causes the spring to swing. The spring's swinging angle is sensed by a torque sensor (44) to determine the shear stress ray (dyne/cm$^2$) of the dispersion.

Figure 5:
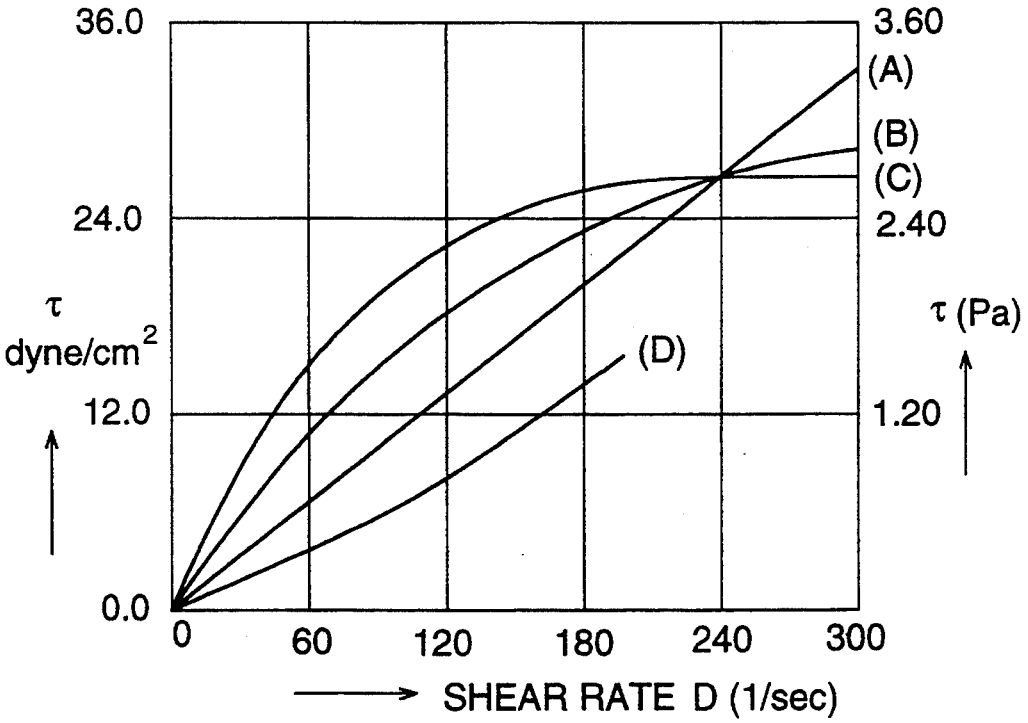
FIG. 5 is a schematic graph showing the fluidity of a dispersion.

FIG. 5 is a schematic graph showing the fluidity of a dispersion, expressed by equation:

$$\tau=\tau_0+\eta D^B$$

The graph shows the fluidities of dispersions A, B, C and D of different dispersibilities, with a function of dispersing speed D (1/sec) (abscissa) and shear stress $\tau$ (dyne/cm$^2$) (ordinate). Also given are exponent B values of 1.0, 0.7, 0.5 and 1.2 for respective fluidities computed from the graph. The ordinate also gives a scale for the Pascal unit (Pa) for shear stress $\tau$.

Referring to FIG. 5, in the case of dispersion A, for example, whose exponent B is 1.0, shear stress $\eta$ increases linearly as shear rate D increases, while the coefficient of viscosity $\eta$ remains constant irrespective of shear rate. Such a liquid is known as a Newtonian liquid or an ideal liquid. Such a dispersion offers a very uniform coating layer because its physical properties are stable with no viscosity change during coating operation.

Although the present invention includes not only Newtonian liquid dispersions but also dispersions showing increased viscosity due to intermolecular association etc. with the increase in shear rate D, and dispersions showing decreased viscosity due to molecular orientation, molecular decomposition, aggregate dissociation etc., the above-described dispersions showing increased viscosity associated with exponent B exceeding 1.3 are excluded from the present invention because their coatability is poor.

Dispersion B has an exponent of 0.7, the lower limit for the present invention; viscosity decreases as shear rate D increases but this reduction does not hamper coating. Dispersion C has an exponent of 0.5, falling out of the range for the present invention; coating unevenness, coating streaks, solution run, and other undesirable phenomena occur due to significant changes in physical properties such as viscosity during coating.

In other words, the validity of the dispersion is determined by the exponent B for the fluidity of the dispersion determined using a Rotovisco fluidity meter etc. with shear rate D (1/sec) and shear stress (dyne/cm$^2$) as parameters, the exponent B defining the scope of the present invention.

In addition, the validity of the dispersion relating to the present invention depends largely on the viscosity of the dispersion, as well as on the exponent B. Accordingly, exponent B and coefficient of viscosity $\eta$ are considered in the present invention. The coefficient of viscosity $\eta$ bears the following relation:

Coefficient of viscosity $\eta$ (dyne/cm$^2$.sec)=shear stress $\tau$ (dyne/cm$^2$)/shear rate D (1/sec)

The coefficient of viscosity $\eta$ is calculated simultaneously with the determination of the shear stress corresponding to shear rate D using the Rotovisco fluidity meter.

Also, since the Rotovisco fluidity meter uses the Pascal (Pa) unit for shear stress and the centipoise (CP) unit for the coefficient of viscosity $\eta$ for practical reasons, $\eta$ values are expressed in the CP unit in the present invention.

The above-described units are converted as follows:

Shear stress 1 Pa=10 dyne/cm$^2$

Coefficient of viscosity 1 dyne/cm$^2$.sec=100 CP

For the values of coefficient of viscosity $\eta$ (CP) given in Examples below, common coefficient of viscosity $\eta$ is used to meet the limiting functional requirements of the measuring instrument.

For example, it is represented by the gradient of the line connecting the zero point and the intersection of the longitudinal axis of shear stress $\tau$ at a given shear rate of 300 (1/sec) and the characteristic curve of dispersion B or C.

Also, there are two approaches to determination of the above-defined fluid properties: ordinary determination from shear rate D=0 (1/sec) to, for example, D=300 (1/sec) and reverse determination from D=300 (1/sec) to D=0 (1/sec). In the latter determination, $\tau_0$ often has a definite value. However, in the present invention, $\tau_0$ is approximately assumed to be 0, since the former determination is employed.

TABLE 2

| Property Sample No | Initial potential Black paper (V) | Initial potential White paper (V) | Potential after 100000 copies Black paper (V) | Potential after 100000 copies White paper (V) | Image quality | B value |
|---|---|---|---|---|---|---|
| Example 7 | −740 | −30 | −750 | −45 | Good | 0.95 |
| 8 | −750 | −45 | −760 | −60 | Good | 0.92 |
| 9 | −73 5 | −40 | −745 | −50 | Good | 0.89 |
| 10 | −735 | −30 | −740 | −55 | Good | 0.92 |
| 11 | −725 | −45 | −730 | −60 | Good | 0.89 |

TABLE 2-continued

| Property Sample No | Initial potential Black paper (V) | Initial potential White paper (V) | Potential after 100000 copies Black paper (V) | Potential after 100000 copies White paper (V) | Image quality | B value |
|---|---|---|---|---|---|---|
| Comp. 8 | −760 | −320 | −750 | −410 | *a | 0.88 |
| 9 | −725 | −60 | −735 | −80 | *b | 0.51 |
| 10 | −720 | −50 | −735 | −80 | *b | 0.62 |
| 11 | −745 | −80 | −740 | −110 | *c | 0.95 |
| 12 | −745 | −60 | −760 | −105 | *d | 0.82 |

*aFogging occurred early.
*bWhite spots appeared in solid black area early.
*cWhite spots appeared in solid black area early, and fogging occurred after 90000 copies were taken.
*dFogging occurred after 100000 copies were taken.

As seen in Table 2, the samples in accordance with the present invention were good in sensitivity, durability and image quality, while the comparative samples had higher white paper potential and tended to have fogging, with white spots appearing in solid black area.

The present invention is hereinafter described in more detail by means of the following example groups A for aqueous washing and B for anode oxidation.

The principle of base hydration is described by means of the following examples.

Example 11

Aluminum base tube washing

After a socket and spigot joint was made at each end, an aluminum alloy drawing tube relating to the present invention was mirror finished using a diamond tool, and then subjected to ultrasonic washing with Tri-Clene and steam drying.

Base tube size: 80 mm dia.×355.5 mm

Base tube surface roughness: Not more than 0.3

Hydration oxidation

After hydration oxidation in 80° C. superpure water for 1 minute, the base tube was drawn up at a rate of 0.5 cm/sec and dried.

Preparation of light-sensitive layer

BAL coating

A BAL coating solution consisting of 1.5 g of polyamide CM8000 (Toray Industries, Inc.) and 100 ml of a 4:1 (by weight) mixture of methanol and n-butanol was dip coated to form an interlayer of 0.2 μm thickness.

CGL coating

A charge generation layer coating solution consisting of 7.5 g of Example Compound A-1, 1.5 g of butyral resin Eslec BX-L (Sekisui Chemical) and 300 ml of methyl ethyl ketone, prepared by dispersion using a sand grinder, was dip coated to form a charge generation layer of 0.5 μm thickness.

CTL coating

A charge transport layer coating solution consisting of 16.5 g of bisphenol Z type polycarbonate resin IUPIRON Z-300 (Mitsubishi Gas Chemical Co., Inc.), 11.75 g of the following charge transport material (C) and 100 ml of dichloroethane was dip coated to form a charge transport layer of 30 μm thickness (dried at 90° C. for 1 hour).

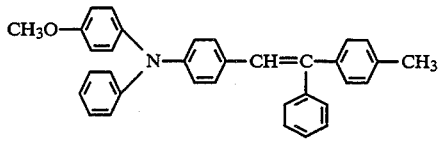

(C)

The thus-obtained photoreceptor sample 11 was evaluated as to various properties as follows:

Evaluation of image quality

The photoreceptor sample 11 of the present invention was used to take a copy on electrophotographic copying machine U-Bix 4045 (Konica Corporation). Using an image analyzer Omnicon 3000 (Shimadzu Corporation), the particle size and number of white dots were measured, and white dot quality was evaluated by the particle size and number of white dot particles per image of A-4 size.

Density reduction was evaluated by densitometry using a reflective densitometer.

Repeatability test

Using the same copying machine as above but equipped with a surface voltameter, the sequential process of charging, exposure and discharge was repeated in 10000 cycles, and the black paper potential $V_B$, white paper potential $V_W$ and residual potential VR were determined just after the first and 10000th copies were taken. Black paper potential is the surface potential of a photoreceptor obtained when an original of an optical density of 1.30 is copied. White paper potential is the surface potential of a photoreceptor obtained when an original of an optical density of 0.00 is copied.

The results are given in Table 3.

Example 2

Photoreceptor sample 2 was prepared and evaluated in the same manner as in Example 1, except that no interlayer was formed. The results are given in Table 1.

Comparative Example 13

Comparative photoreceptor sample 13 was prepared and evaluated in the same manner as in Example 11, except that Example Compound A-1, as a charge generation material, was replaced with the following perillene compound C-1.

Comparative Example 14

Comparative photoreceptor sample 14 was prepared and evaluated in the same manner as in Example 11, except that Example Compound A-1 for photoreceptor sample 2 was replaced with the following perillene compound D. The results are given in Table 3.

TABLE 3

(C-1)

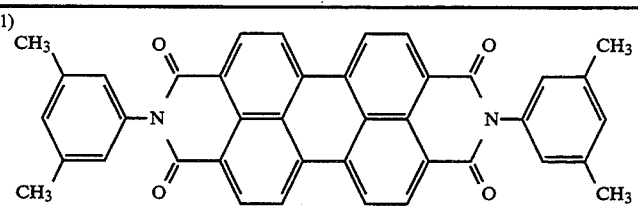

| Photoreceptor sample No. | Interlayer | Image failures 1 copy taken | Image failures 10000 copies taken |
|---|---|---|---|
| Example 11 | Yes | A | A |

TABLE 3-continued

| | | | |
|---|---|---|---|
| 12 | No | A | B |
| Comparative Sample 13 | Yes | C | D |
| 14 | No | D | D |

| Sample No. | Durability: 1 copy taken $V_B(-V)$ | $V_W(-V)$ | $V_R(-V)$ | 10000 copies taken $V_B(-V)$ | $V_W(-V)$ | $V_R(-V)$ |
|---|---|---|---|---|---|---|
| Example | | | | | | |
| 11 | 721 | 76 | 10 | 718 | 87 | 37 |
| 12 | 708 | 84 | 13 | 705 | 90 | 40 |
| Comp. | | | | | | |
| 13 | 682 | 210 | 48 | 570 | 283 | 120 |
| 14 | 677 | 305 | 46 | 550 | 379 | 119 |

Evaluation of imaging failures

A: Image density not lower than 1.3 and the number of 0.3 mm or greater white dots 0 (per A4 paper)

B: Image density not lower than 1.2 and the number of 0.3 mm to 0.5 mm white dots 5 or less and the number of 0.5 mm or greater white dots 0 (per A4 paper)

C: Image density not lower than 1.2 and the number of 0.3 mm or greater white dots 6 or more (per A4 paper), or image density lower than 1.2 and the number of 0.3 mm to 0.5 mm white dots 5 or less (per A4 paper)

D: Image density lower than 1.2 and the number of 0.3 mm or greater white dots 6 or more (per A4 paper)

From Table 3, it is seen that the photoreceptor samples in accordance with the present invention have no image failures and excellent chargeability and cause no rise in residual potential with no reduction in charging potential even after 10000 copies were taken even when an aluminum base tube having a hydrated oxidized aluminum layer thereon is used.

The present invention provides a photoreceptor which have no image failures and excellent chargeability and cause no rise in residual potential with no reduction in charging potential even after 10000 copies were taken even when an aluminum base tube having a hydrated oxidized aluminum layer thereon is used.

Example group A

Example A1

Aluminum base tube

After a socket and spigot joint was made at each end, an aluminum alloy drawing tube relating to the present invention was mirror finished using a diamond tool.

Base tube size: 80 mm dia.×355.5 mm

Base tube surface roughness: Not more than 0.3

Aluminum base tube washing (1) Ultrasonic washing

The aluminum base tube was ultrasonically washed with a 10% aqueous solution of nonionic surfactant (Sonic Fellow SE-115) at 40° C. for 60 seconds, using two ultrasonicators at 28 kHz set on the chamber's bottom and side, respectively. Rotation and vibration were both employed.

(2) Sponge rubbing washing

The aluminum base tube was then washed by rubbing with a Belclean (Kanebo) sponge in the above aqueous solution of surfactant (40° C).

(3) Rinsing

The aluminum base tube was ultrasonically rinsed (28 kHz frequency) in superpure water (resistivity not lower than 5 Ωcm, 40° C.).

(4) Drying

After immersion in superpure water at 40° C. for 1 minute, the aluminum base tube was drawn up at 0.5 cm/sec and dried.

BAL coating solution 1.5 g of polyamide CM8000 (Toray Industries, Inc.), as a binder, was dissolved in 100 ml of a 4:1 (by weight) mixture of methanol and butanol.

CGL coating solution 7.5 g of BIPP (Example Compound A-1), as CGL, 1.5 g of butyral resin Eslec BX-L (Sekisui Chemical), as a binder, and 300 ml of methyl ethyl ketone, as a solvent, were dispersed for 10 hours using a sand grinder.

CTL coating solution 11.25 g of the following compound (T-1), as CTM and 15 g of BPZ type polycarbonate IUPIRON Z-300 (Mitsubishi Gas Chemical Co., Inc.), as a binder were dissolved in 100 ml of dichloroethane.

Preparation of photoreceptor

The above-described aluminum drum after aqueous washing was dip coated with the BAL coating solution to form a BAL of 0.2 μm dry thickness.

The CGL coating solution was then dip coated to form a CGL of 0.5 μm dry thickness, followed by dip coating of the CTL coating solution to form a CTL of 20 μm dry thickness, to yield photoreceptor sample A1.

Example A2

Photoreceptor sample 2 was prepared in the same manner as in Example A1 except that ASL was not coated.

Comparative Example A1

Comparative photoreceptor A1 was prepared in the same manner as in Example A1, except that Example Compound A-1, as CGM for CGL coating solution, was replaced with the perillene compound C-1 of formula 6.

Comparative Example A2

(T-1)

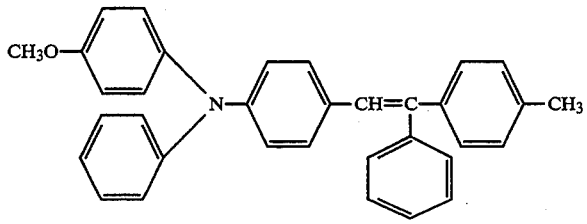

(C-1)

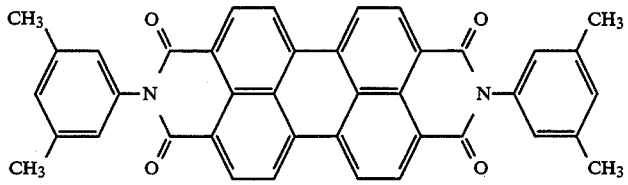

Each photoreceptor sample thus obtained was evaluated as to various properties as follows: The results are given in Table 4.

Image quality

Each photoreceptor sample was used to take a copy of a white paper chart on electrophotographic copying machine U-Bix 4045 (Konica Corporation).

(1) White dots

Using an image analyzer Omnicon 3000 (Shimadzu Corporation), the particle size and number of white dots were measured, and white dot quality was evaluated by the number of 0.05 mm or greater white dot particles/cm$^2$ using the following criteria:

| Evaluation symbol | Number of 0.05 mm or greater white dots/cm$^2$ | Judgment |
|---|---|---|
| A | 0 | Suitable |
| B | 1–3 | Suitable |
| C | 4–10 | Limit |
| D | 11–20 | Unacceptable |
| E | 21 or more | Unacceptable |

(2) Image density

Determined by densitometry using a reflective densitometer.

(3) Image quality

Evaluated by a combination of image density and white dot quality.

A: Image density not lower than 1.3 and the number of 0.3 mm or greater white dots 0 (per A4 paper)

B: Image density not lower than 1.2 and the number of 0.3 ram to 0.5 mm white dots 5 or less and the number of 0.5 mm or greater white dots 0 (per A4 paper)

C: Image density not lower than 1.2 and the number of 0.3 mm or greater white dots 6 or more (per A4 paper), or image density lower than 1.2 and the number of 0.3 mm to 0.5 mm white dots 5 or less (per A4 paper)

D: Image density lower than 1.2 and the number of 0.3 mm or greater white dots 6 or more (per A4 paper)

Durability

Using the same copying machine U-Bix 4045 as above but equipped with a surface voltameter, the sequential process of charging, exposure and discharge was repeated in 10000 cycles, and the black paper potential, white paper potential and residual potential differential ΔVr(V) were determined just after the first and 10000th copies were taken.

White paper potential Vw(v): Drum surface potential for an original of a density of 0.0.

Black paper potential Vb(V): Drum surface potential for an original of a reflex density of 1.30.

TABLE 4

| Photoreceptor sample No. | Image quality: 1 copy taken | Image quality: 10000 copies taken |
|---|---|---|
| Example A-1 | A | A |
| A-2 | A | B |
| Comparative Sample A-1 | C | D |
| A-2 | D | D |

| Sample No. | Durability: 1 copy taken $V_B$ (-V) | $V_W$ (-V) | $V_R$ (-V) | 10000 copies taken $V_B$ (-V) | $V_W$ (-V) | $V_R$ (-V) |
|---|---|---|---|---|---|---|
| Example A1 | 750 | 76 | 10 | 700 | 85 | 34 |
| A2 | 700 | 84 | 18 | 692 | 100 | 55 |
| Comp. A1 | 700 | 210 | 48 | 580 | 283 | 111 |
| A2 | 698 | 308 | 80 | 512 | 411 | 203 |

Example group B

Example B1

Anode oxidation of aluminum base

After mirror finish by surface cutting, an aluminum base of 80 mm outside diameter and 355.5 mm length was washed with a commercially available neutral decreasing agent and then with water, followed by etching in a 5 wt % NaOH solution at 40° C. for 30 seconds, water washing and anode oxidation.

Anode oxidation was achieved by dipping the aluminum base in a 15 wt % sulfuric acid solution at a bath temperature of 20° C. and a current density of 1 A/dm$^2$ to form a 6 μm film, after which the aluminum base was washed with water and then dipped in a nickel acetate solution at 50° C. for 10 minutes for a pore sealing treatment.

Preparation of light-sensitive layer

BAL coating

A solution of 1.5 g of polyamide CM8000 (Toray Industries, Inc.) in 100 ml of a 4:1 (by weight) mixture of methanol and butanol was dip coated to form a BAL of 0.2 μm layer thickness.

CGL coating 7.5 g of Example Compound A-1, butyral resin Eslec BX-L (Sekisui Chemical) and 300 ml of MEK were dispersed using a sand grinder. The resulting CGL coating solution was dip coated to form a CGL of 0.5 μm thickness.

CTL coating

A CTL coating solution, consisting of bisphenol Z type polycarbonate resin IUPIRON Z-300 (Mitsubishi Gas Chemical Co., Inc.), 11.75 g of the above CTM compound T-1 and 100 ml of dichloroethane, was dip coated to form a CTL of about 20 μm layer thickness (dried at 90° C. for 1 hour).

Example B2

A photoreceptor sample was prepared in the same manner as in Example 1 except that BAL was not coated.

Comparative Example B1

A comparative photoreceptor sample was prepared in the same manner as in Example B1, except Chat the Example Compound A-1, as CGM, was replaced with the above-mentioned compound C1.

Comparative Example B2

A comparative photoreceptor sample was prepared in the same manner as in Comparative Example B1, except that BAL was not coated.

Each photoreceptor sample thus obtained was evaluated as to various properties in the same manner as in Example group A. The results are given in Table 5.

TABLE 5

| Photoreceptor sample No. | Image quality | |
|---|---|---|
| | 1 copy taken | 10000 copies taken |
| Example B-1 | A | A |
| B-2 | A | B |
| Comparative Sample B-1 | C | D |
| B-2 | D | D |

| | Durability | | | | | |
|---|---|---|---|---|---|---|
| | 1 copy taken | | | 10000 copies taken | | |
| Sample No. | $V_B$ (-V) | $V_W$ (-V) | $V_R$ (-V) | $V_B$ (-V) | $V_W$ (-V) | $V_R$ (-V) |
| Example | | | | | | |
| B-1 | 701 | 68 | 8 | 700 | 82 | 30 |
| B-2 | 700 | 82 | 20 | 695 | 107 | 53 |
| Comp. | | | | | | |
| B-1 | 692 | 232 | 51 | 572 | 291 | 120 |
| B-2 | 686 | 302 | 82 | 515 | 408 | 203 |

The present invention is hereinafter described in more detail by means of the following example groups A for the use of a roller charger and B for the use of a toner relating to the present invention.

Example group A

Examples 13 through 15 and Comparative Examples 15 and 16

Preparation of photoreceptor sample 13

30 g of polyamide resin CM-8000 (Toray Industries, Inc.) was added in 100 ml of a mixture of 900 ml of methanol and 100 ml of 1-butanol and dissolved while heating at 50° C. This solution was dip coated on an aluminum drum base of 80 mm outside diameter and 355.5 mm length to form a BAL of 0.5 μm thickness.

Next, 2 g polyvinyl butyral resin Eslec BX-1 (Sekisui Chemical) was dissolved in 300 ml of a mixed solvent of 700 ml of methyl ethyl ketone and 300 ml of cyclohexanone. To this solution was added 3 g of CGM (Example Compound A-1), followed by dispersion for 10 hours using a sand mill. This coating solution was dip coated on the above BAL to form a CGL of 0.3 μm thickness.

Next, 150 g of CTM compound T-1 of formula 8 and 200 g of polycarbonate resin IUPIRON Z-200 (Mitsubishi Gas Chemical Co., Inc.) were dissolved in 1000 ml of 1,2-dichloroethane. This solution was dip coated on the above CGL and dried at 100° C. for 1 hour to form a CTL of 20 μm thickness. Multiple-layered photoreceptor sample 13 consisting of ASL, CGL and CTL was thus obtained.

Preparation of photoreceptor sample 14

ASL was formed on an aluminum drum in the same manner as in the preparation of photoreceptor sample 13, except that the resin for BAL was replaced with polyamide resin Diamide X-1874M (Daicel Huls Ltd.).

Next, 2.5 g of polyester resin Vyron 200 (Toyobo Co., Ltd.) was dissolved in 1000 ml of 1,2-dichloroethane. To this solution was added 5 g of CGM (Example Compound A-6), followed by dispersion for 20 hours using a sand mill. This solution was dip coated on the above BAL to form a CGL of 1.00 μm thickness.

CTL was formed in the same manner as in the preparation of photoreceptor sample 13 except that the CTM was replaced with the following compound T-2 to yield multiple-layered photoreceptor sample 14.

Preparation of photoreceptor sample 15

Multiple-layered photoreceptor sample 15 was prepared in the same manner as in the preparation of photoreceptor sample 1, except that the CGM was replaced with Example Compound A-13 and the CTM with the following compound T-3.

Preparation of comparative photoreceptor sample 15

Comparative photoreceptor sample 15 was prepared in the same manner as in the preparation of photoreceptor sample 2, except that the CGM was replaced with the following compound B-1.

Preparation of comparative photoreceptor sample 16

Comparative photoreceptor sample 16 was prepared in the same manner as in the preparation of photoreceptor sample 1, except that the CGM was replaced with the following compound C-1.

A developer for U-Bix 3035 was used to form images.

(T-1)

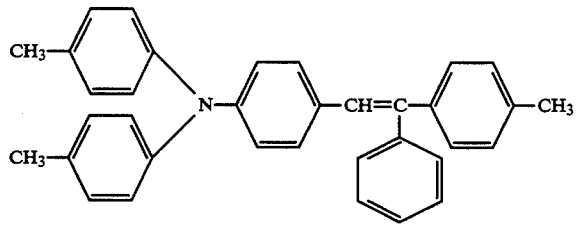

-continued (T-2)

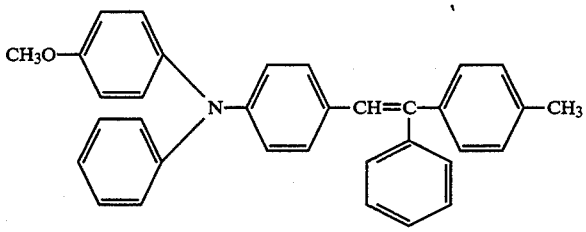

(T-3)

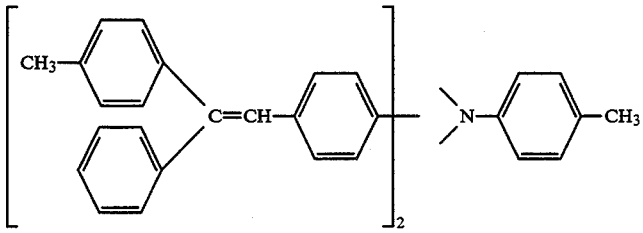

(B-1)

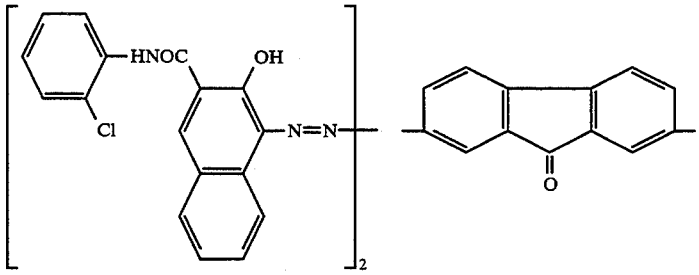

(C-1)

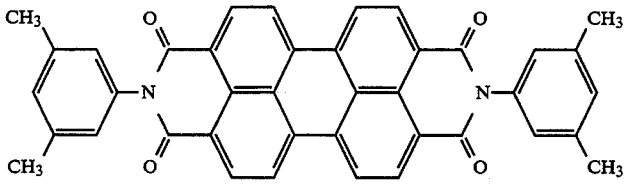

Evaluation of photoreceptor samples

Each photoreceptor sample thus obtained was tested as to the uniformity of surface chargeability and dischargeability using a defect detector system (produced by Toreck).

The detector, configured with a staggered series of plate electrodes of about 2 mm width, was placed about 100 μm apart from the drum along the drum's axial direction, and potential unevenness was detected over the entire surface of the drum being revolved. Potential unevenness, if any, causes an inductive current compensating for the unevenness. This inductive current is rated and expressed as standard deviation.

1) Charge potential

After charging at a surface potential of about −800 V, using a scorotron electrification electrode, the surface potential was recorded as a function of the drum's circumferential angle and the distance from the drum's end to obtain the mean and standard deviation of drum potential.

Potential unevenness was evaluated by the standard deviation value.

2) Half-tone potential

Next, the photoreceptor was discharged to about −300 V using an LED source of variable luminance, and potential unevenness evaluated in the same manner as in as in term 1 above.

Evaluation of image quality

Each photoreceptor sample obtained above was used to take 100000 copies on U-Bix 3035 (Konica Corporation), modified by replacing the corona electrification electrode with a charging roller and the corona transfer electrode with a transfer roller, and the copied images were sequentially evaluated as to various items as follows:

1) Imaging performance

Each copied image was macroscopically evaluated as to image unevenness and imaging failures (transfer failures), using the following criteria:

A: No imaging unevenness or imaging failure

B: 1 to 3 imaging failures seen (A-4 size paper) but practically unproblematic

C: Significant imaging unevenness and many imaging failures, posing practical problem 2) Succedability In accordance with JIS Z4916, copies were taken to the 5th generation, using a chart with 8.0 equally spaced transversal lines per mm, and the final generation at which the transversal lines can be differentiated was determined as the image succedability.

The results are given in Table 6.

TABLE 6

| Sample | Photo-receptor Sample No. | Potential unevenness Electrification | Potential unevenness Half-tone | Image Quality Image quality | Image Quality Imaging failures | Image succedability (number of generations) |
|---|---|---|---|---|---|---|
| | | | Initial | | | |
| Example 13 | 13 | ±5 | ±7 | A | A | 5 |
| 14 | 14 | ±8 | ±9 | A | A | 5 |
| 15 | 15 | ±7 | ±8 | A | A | 5 |
| COMP. 15 | 16 | ±50 | ±70 | C | C | 3 |
| COMP. 16 | 17 | ±55 | ±80 | C | C | 2 |
| | | After 100000 copies taken | | | | |
| Example 13 | 13 | Within ±50 | Within N ±50 | A | A | 5 |
| 14 | 14 | Within ±50 | Within ±50 | A | A | 5 |
| 15 | 15 | Within ±50 | Within ±50 | A | A | 5 |
| COMP. 15 | 16 | ±65 | ±85 | B | B | 4 |
| COMP. 16 | 17 | ±70 | ±95 | B | B | 3 |

From Table 6, it is seen that the samples according to the present invention had little potential unevenness and good image quality and succedability even when copies were taken using a roller charger.

Example group B

Examples 17 through 22 and Comparative Examples 1 through 5

Preparation of toner samples

Toner samples 1, 2 and 3 and comparative toner samples 1 and 2 were prepared in the same manner as in the preparation of toners for the electrophotographic copying machine U-Bix 3035 (Konica Corporation), in which operating conditions for jet mill pulverization and subsequent pneumatic classification were adjusted to have average grain sizes of 5 μm, 7 μm, 9 μm, 10 μm and 12 μm, respectively.

Preparation of developing agent

To each toner were added fine inorganic grains, followed by mixing in a Henschel mixer to adsorb the inorganic grains to the toner grains, and a carrier was added, to obtain a developing agent.

The photoreceptors obtained in Example group A were combined with the above toner samples 1, 2 and 3 and comparative toner samples 1 and 2, and each combination was evaluated for imaging performance as follows:

Evaluation of image quality

Each photoreceptor sample obtained above was used in combination with each toner sample or comparative toner sample to take 100000 copies on U-Bix 3035 (Konica Corporation), and the copied images were sequentially evaluated as to various items in two phases (phase A for 0 to 1000 copies, phase B for 100000±1000 copies) as follows:

1) Image quality

Each copied image was macroscopically evaluated as to image unevenness and imaging failures (transfer failures), using the following criteria:

A: No imaging unevenness or imaging failure

B: 1 to 3 imaging failures seen (A-4 size paper) but practically unproblematic

C: Significant imaging unevenness and many imaging failures, posing practical problem. The numeral shows the number of copy sheets that an imaging failure starts.

2) Succedability

In accordance with JIS Z4916, copies were taken to the 5th generation, using a chart with 8.0 equally spaced transversal lines per mm, and the final generation at which the transversal lines can be differentiated was determined as the image succedability.

The results are given in Table 7.

TABLE 7

| Sample | Photo-receptor Sample No. | Toner No. | Potential unevenness Electrification | | Half-tone | |
|---|---|---|---|---|---|---|
| Example | | | | | | |
| 17 | 13 | 1 | ±5 | ±10 | ±7 | ±13 |
| 18 | 13 | 2 | +5 | ±10 | ±7 | ±13 |
| 19 | 13 | 3 | +5 | ±10 | ±7 | ±13 |
| 20 | 14 | 1 | ±8 | ±12 | ±9 | ±14 |
| 21 | 14 | 2 | ±8 | ±12 | ±9 | ±14 |
| 22 | 14 | 3 | ±8 | ±12 | ±9 | ±14 |
| Comp. | | | | | | |
| 16 | 13 | Comp. (1) | ±5 | ±10 | ±7 | ±13 |
| 17 | 13 | Comp. (2) | ±5 | ±10 | ±7 | ±13 |
| 18 | 14 | Comp. (1) | ±8 | ±12 | ±9 | ±14 |
| 19 | 14 | Comp. (2) | ±8 | ±12 | ±9 | ±14 |
| 20 | Comp. (15) | 2 | ±50 | ±65 | ±70 | ±85 |

| Sample | Image Quality: Image unevenness A | Image unevenness B | Imaging failures A | Imaging failures B | Image succedability (number of generations) A | Image succedability B |
|---|---|---|---|---|---|---|
| Example | | | | | | |
| 17 | A | A | A | A | 5 | 5 |
| 18 | A | A | A | A | 5 | 5 |
| 19 | A | A | A | A | 5 | 5 |
| 20 | A | A | A | A | 5 | 5 |
| 21 | A | A | A | A | 5 | 5 |
| 22 | A | A | A | A | 5 | 5 |
| Comp. | | | | | | |
| 16 | A | C (60000) | A | C (60000) | 4 | 3 |
| 17 | A | C (40000) | A | C (50000) | 3 | 2 |
| 18 | A | C (60000) | A | C (60000) | 4 | 3 |
| 19 | A | C (50000) | A | C (50000) | 3 | 2 |
| 20 | A | C (80000) | A | C (70000) | 4 | 3 |

From Table 7, it is seen that the use of a toner relating to the present invention gives good results as to image quality and succedability.

The BIPP-incorporating photoreceptor relating to the present invention offers improved applicability of roller charging and fine toners based on prevention of uneven coating and surface failures, thus allowing remarkably increased image quality and copying succedability without influence of potential unevenness.

We claim:

1. A photoreceptor comprising an electroconductive support, a barrier layer, a charge generation layer and a charge transport layer, all formed on the support in this order, wherein the barrier layer consists of an alcohol-soluble copolymerized polyamide resin, the charge generation layer contains a compound represented by formula I or II, and the charge transport layer contains a polycarbonate resin having a molecular weight of not less than 100000,

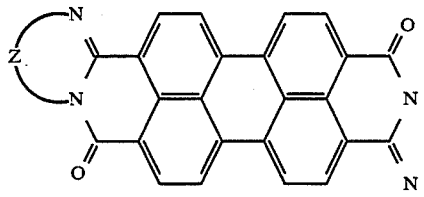

I

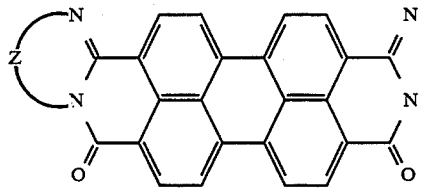

II wherein Z represents a group of atoms necessary to form a substituted or unsubstituted divalent aromatic ring.

2. A photoreceptor of claim 1, wherein the charge transport layer is provided by coating the polycarbonate dissolved with a highly capable of dissolving solvent.

3. A photoreceptor of claim 2, wherein the highly capable of dissolving solvent is methylene chloride, tetrahydrofuran or chloroform.

4. A photoreceptor of claim 1, wherein the barrier layer is an alcohol-soluble co-polymerized polyamide resin.

5. A photoreceptor of claim 4, wherein the CTM contained in CTL is a compound represented by formula Ta or Tb;

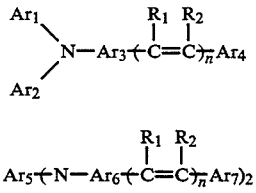

Ta

Tb wherein $Ar_1$, $Ar_2$, $Ar_4$, $Ar_5$ and $Ar_7$ independently represent a substituted or unsubstituted aryl group; $Ar_3$ and $Ar_6$ independently represent a substituted or unsubstituted arylene group; $R_1$ and $R_2$ independently represent a hydrogen atom, alkyl group or aryl group which may have a substituent; n represents the integer 1 or 2.

6. A photoreceptor of claim 5, wherein the charge generation layer comprises the charge generation material contained in a polyvinyl butyral resin having a degree of butyralation of not lower than 70 mol %, the charge generation layer is provided by coating the charge generation material contained in a polyvinyl butyral resin dissolved with a ketone solvent as the major solvent and fluidity of charge generation layer coating compound meets condition of:

$$\tau=\tau_0+\eta D^B(0.7\leqq B\leqq 1.3)$$

where $\tau$ represents shear stress, D represents shear rate, $\eta$ represents coefficient of viscosity, $\tau_0$ represents a value for $\tau$ when D is 0, and B represents exponent of D.

7. A photoreceptor of claim 6, wherein electroconductive support is an aluminum magnesium alloy containing not more than 0.2% by weight of iron (Fe), and not more than 0.2% by weight of Si.

8. A photoreceptor of claim 7, wherein surface of the support is subjected to aqueous washing.

9. A photoreceptor of claim 7, wherein surface of the support is subjected to anode oxidation.

10. A photoreceptor of claim 7, wherein the support has a hydrated oxidized aluminum layer at surface.

11. A photoreceptor of claim 1 wherein the barrier layer is an alcohol-soluble co-polymerized polyamide resin.

12. A photoreceptor of claim 2 wherein the barrier layer is an alcohol-soluble co-polymerized polyamide resin.

13. A photoreceptor of claim 12, wherein the CTM contained in CTL is a compound represented by formula Ta or Tb;

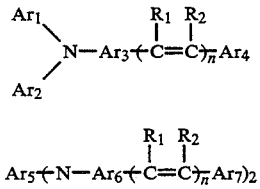

Ta

Tb wherein $Ar_1$, $Ar_2$, $Ar_4$, $Ar_5$ and $Ar_7$ independently represent a substituted or unsubstituted aryl group; $Ar_3$ and $Ar_6$ independently represent a substituted or unsubstituted arylene group; $R_1$ and $R_2$ independently represent a hydrogen atom, alkyl group or aryl group which may have a substituent; n represents the integer 1 or 2.

14. A photoreceptor of claim 1, wherein the CTM contained in CTL is a compound represented by formula Ta or Tb.

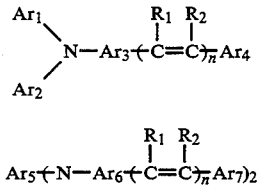

Ta

Tb wherein $Ar_1$, $Ar_2$, $Ar_4$, $Ar_5$ and $Ar_7$ independently represent a substituted or unsubstituted aryl group; $Ar_3$ and $Ar_6$ independently represent a substituted or unsubstituted arylene group; $R_1$ and $R_2$ independently represent a hydrogen atom, alkyl group or aryl group which may have a substituent; n represents the integer 1 or 2.

15. A photoreceptor of claim 5, wherein the charge generation layer comprises the charge generation material contained in a polyvinyl butyral resin having a degree of butyralation of not lower than 70 mol %, the charge generation layer is provided by coating the charge generation material contained in a polyvinyl butyral resin dissolved with a ketone solvent as the major solvent and fluidity of charge generation layer coating compound meets condition of:

$$\tau=\tau_0+\eta D^B(0.7\leqq B\leqq 1.3)$$

where $\tau$ represents shear stress, D represents shear rate, $\eta$ represents coefficient of viscosity, $\tau_0$ represents a value for $\tau$ when D is 0, and B represents exponent of D.

16. A photoreceptor of claim 1, wherein electroconductive support is an aluminum magnesium alloy containing not more than 0.2% by weight of iron (Fe) and not more than 0.2% by weight of Si.

17. A photoreceptor of claim 1, wherein surface of the support is subjected to aqueous washing.

18. A photoreceptor of claim 1, wherein surface of the support is subjected to anode oxidation.

19. A photoreceptor of claim 1, wherein the support has a hydrated oxidized aluminum layer at surface.

20. A photoreceptor of claim 16, wherein surface of the support is subjected to aqueous washing.

21. A photoreceptor of claim 16, wherein surface of the support is subjected to anode oxidation.

22. A photoreceptor of claim 16, wherein the support has a hydrated oxidized aluminum layer at surface.

23. An image forming process comprising charging, exposing a photoreceptor to light imagewise for forming a latent image on the photoreceptor, developing the latent image with developer comprising toner, and transfering a developed image on a photoreceptor to a transferee, wherein the charging is conducted by means of a charger in contact with the photoreceptor, and the photoreceptor comprises an electroconductive support, a barrier layer, a charge generation layer and a charge transport layer, all formed on the support in this order, the charge generation layer containing a compound represented by formula I or II,

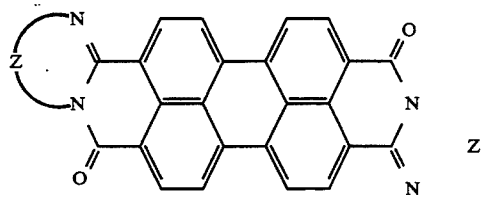

I

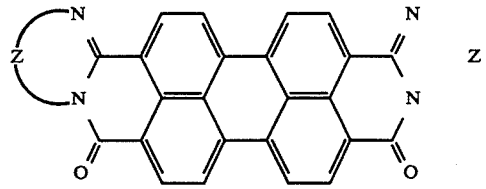

II wherein Z represents a group of atoms necessary to form a substituted or unsubstituted divalent aromatic ring.

24. An image forming process of claim 23 wherein the toner has a number-average primary grain size of not more than 9 μm.

25. An image forming process of claim 24 wherein the charger is a roller charger.

26. An image forming process of claim 24 wherein the charger is a magnetic brush charger.

27. An image forming process of claim 26 wherein the charge transport layer contains a polycarbonate resin having a molecular weight of not less than 100000.

28. An image forming process of claim 27, wherein the charge transport layer is provided by coating the polycarbonate dissolved with a highly capable of dissolving solvent

29. A image forming process of claim 28, wherein the highly capable of dissolving solvent is methylene chloride, tetrahydrofuran or chloroform.

30. A image forming process of claim 29, wherein the barrier layer is an alcohol-soluble co-polymerized polyamide resin.

31. A image forming process of claim 30, wherein the CTM contained in CTL is a compound represented by formula Ta or Tb;

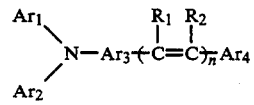

Ta

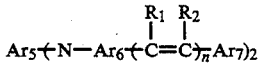

Tb wherein $Ar_1$, $Ar_2$, $Ar_4$, $Ar_5$ and $Ar_7$ independently represent a substituted or unsubstituted aryl group; $Ar_3$ and $Ar_6$ independently represent a substituted or unsubstituted arylene group; $R_1$ and $R_2$ independently represent a hydrogen atom, alkyl group or aryl group which may have a substituent; n represents the integer 1 or 2.

32. A image forming process of claim 31, wherein the charge generation layer comprises the charge generation material contained in a polyvinyl butyral resin having a degree of butyralation of not lower than 70 mol %, the charge generation layer is provided by coating the charge generation material contained in a polyvinyl butyral resin dissolved with a ketone solvent as the major solvent and fluidity of charge generation layer coating compound meets condition of:

$$\tau=\tau_0+\eta D^B(0.7\leqq B\leqq 1.3)$$

where $\tau$ represents shear stress, D represents shear rate, $\eta$ represents coefficient of viscosity, $\tau_0$ represents a value for $\tau$ when D is 0, and B represents exponent of D.

33. A image forming process of claim 32, wherein electroconductive support is an aluminum magnesium alloy containing not more than 0.2% by weight of iron (Fe), and not more than 0.2% by weight of Si.

34. A image forming process of claim 33, wherein surface of the support is subjected to aqueous washing.

35. A image forming process of claim 33, wherein surface of the support is subjected to anode oxidation.

36. A image forming process of claim 3, wherein the support has a hydrated oxidized aluminum layer at surface.

* * * * *

UNITED STATES PATENT AND TRADEMARK OFFICE

CERTIFICATE OF CORRECTION

PATENT NO. : 5,434,027

DATED : July 18, 1995

INVENTOR(S) : Takeo Oshiba; Yoshihiko Etoh; Asao Matsushima; Yoshiaki Takei

It is certified that error appears in the above-indentified patent and that said Letters Patent is hereby corrected as shown below:

col. 2, lines 40-55, and also on title page, in the abstract, formulae I and II

"

I

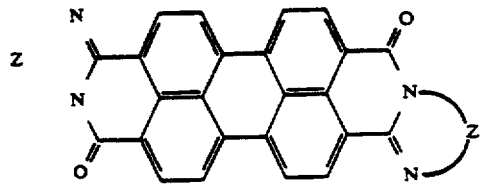

II

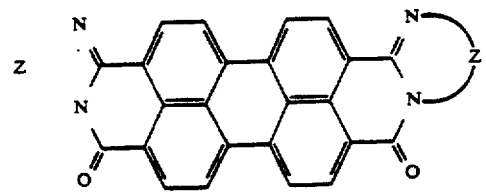

"

UNITED STATES PATENT AND TRADEMARK OFFICE

CERTIFICATE OF CORRECTION

PATENT NO. : 5,434,027

DATED : July 18, 1995

INVENTOR(S) : Takeo Oshiba; Yoshihiko Etoh; Asao Matsushima; Yoshiaki Takei

It is certified that error appears in the above-indentified patent and that said Letters Patent is hereby corrected as shown below:

Should read

-- I

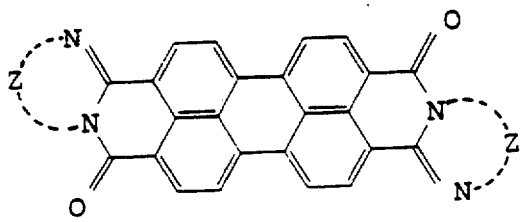

II

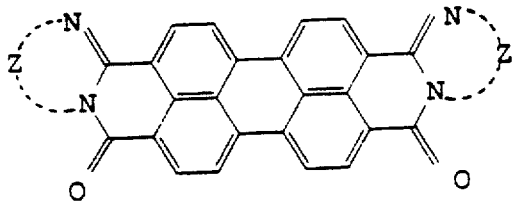

--.

UNITED STATES PATENT AND TRADEMARK OFFICE

CERTIFICATE OF CORRECTION

PATENT NO. : 5,434,027

DATED : July 18, 1995

INVENTOR(S) : Takeo Oshiba; Yoshihiko Etoh; Asao Matsushima; Yoshiaki Takei

It is certified that error appears in the above-indentified patent and that said Letters Patent is hereby corrected as shown below:

Claim 1, col. 39, lines 22-37 and Claim 23, col. 41, lines 52-67, formulae I and II

"

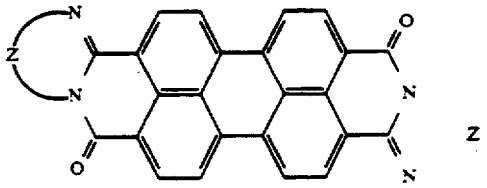

I

"

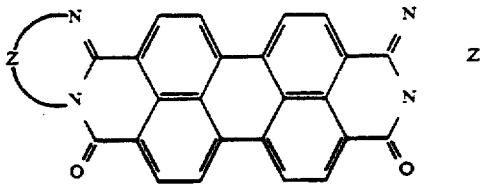

II

UNITED STATES PATENT AND TRADEMARK OFFICE

CERTIFICATE OF CORRECTION

PATENT NO. : 5,434,027

DATED : July 18, 1995

INVENTOR(S) : Takeo Oshiba; Yoshihiko Etoh; Asao Matsushima; Yoshiaki Takei

It is certified that error appears in the above-indentified patent and that said Letters Patent is hereby corrected as shown below:

Should read

I

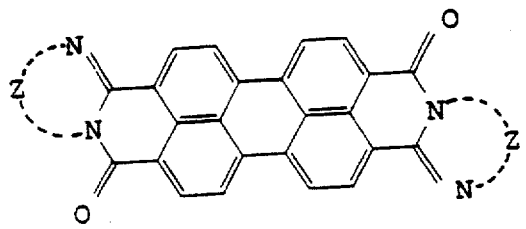

II

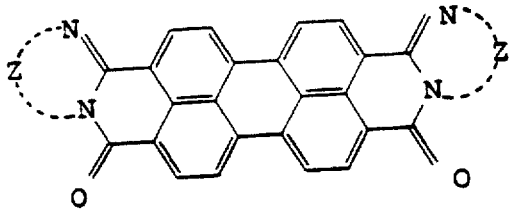

UNITED STATES PATENT AND TRADEMARK OFFICE

CERTIFICATE OF CORRECTION

PATENT NO. : 5,434,027

DATED : July 18, 1995

INVENTOR(S) : Takeo Oshiba; Yoshihiko Etoh; Asao Matsushima; Yoshiaki Takei

It is certified that error appears in the above-indentified patent and that said Letters Patent is hereby corrected as shown below:

Claim 14, col. 40, line 56, "Tb." should read --Tb;--.

Claim 23, col. 41, line 42, "transfering" should read --transferring--.

Claim 28, col. 42, line 17, "solvent" should read --solvent.--

In claim 29, col. 42, line 18;
claim 30, col. 42, line 21;
claim 31, col. 42, line 23;
claim 32, col. 42, line 42;
claim 33, col. 42, line 57;
claim 34, col. 42, line 51;
claim 35, col. 42, line 63; and
claim 36, col. 42, line 65, "A" (all occurences) should read --An--.

Claim 36, col. 42, line 65, "claim 3" should read --claim 33--.

Signed and Sealed this

Thirtieth Day of July, 1996

*Attest:*

*Attesting Officer*

BRUCE LEHMAN

*Commissioner of Patents and Trademarks*